US011609526B2

(12) United States Patent
Saito

(10) Patent No.: US 11,609,526 B2
(45) Date of Patent: Mar. 21, 2023

(54) FIXING DEVICE

(71) Applicant: CANON KABUSHIKI KAISHA, Tokyo (JP)

(72) Inventor: Shutaro Saito, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 478 days.

(21) Appl. No.: 15/832,923

(22) Filed: Dec. 6, 2017

(65) Prior Publication Data

US 2018/0164734 A1 Jun. 14, 2018

(30) Foreign Application Priority Data

Dec. 9, 2016 (JP) ..... JP2016-239247

(51) Int. Cl.
*G03G 15/00* (2006.01)
*G03G 15/20* (2006.01)
*G03G 21/16* (2006.01)

(52) U.S. Cl.
CPC ..... *G03G 15/70* (2013.01); *G03G 15/2028* (2013.01); *G03G 15/2035* (2013.01); *G03G 21/1638* (2013.01)

(58) Field of Classification Search
CPC ..... G03G 15/6573; G03G 15/2028; G03G 15/2032; G03G 15/2035; G03G 2215/00413; G03G 2215/20; G03G 2215/2003; G03G 2215/2025; G03G 2215/2029; G03G 2215/2041; G03G 2221/1639
See application file for complete search history.

(56) References Cited

U.S. PATENT DOCUMENTS 8,779,335 B2 7/2014 Saito
8,958,716 B2 2/2015 Saito
9,389,554 B2 7/2016 Tanaka et al.
(Continued)

FOREIGN PATENT DOCUMENTS

JP H61-294477 A 12/1986
JP 2003-122148 A 4/2003
(Continued)

OTHER PUBLICATIONS

Office Action dated Apr. 24, 2018, issued in Japanese Patent Application No. 2016-239247.

*Primary Examiner* — Jennifer Bahls
*Assistant Examiner* — Quang X Nguyen
(74) *Attorney, Agent, or Firm* — Venable LLP

(57) ABSTRACT

A fixing device includes first and second rotatable members, a moving mechanism, a flag, a sensor, a movable guide, and a stationary guide. The moving mechanism is configured to move the first rotatable member away from the second rotatable member. The flag is provided downstream of the nip with respect to a recording material feeding direction and retractable by passing of the recording material. The sensor is configured to detect whether or not the flag is retracted by contact with the recording material. The movable guide is movable together with the first rotatable member away from the second rotatable member and from the flag by the moving mechanism. The stationary guide is fixed at a position opposing the flag, irrespective of a position of the movable guide member. The stationary guide does not move together with the movable guide.

11 Claims, 14 Drawing Sheets

(56) References Cited

U.S. PATENT DOCUMENTS

| | | | | |
|---|---|---|---|---|
| 9,465,336 | B2 | 10/2016 | Saito | |
| 9,563,163 | B2 | 2/2017 | Tanaka et al. | |
| 2005/0191070 | A1* | 9/2005 | Izawa | G03G 15/2046 399/44 |
| 2005/0286916 | A1* | 12/2005 | Nakazato | G03G 15/6573 399/16 |
| 2010/0303521 | A1* | 12/2010 | Ogawa | G03G 15/2007 399/323 |
| 2011/0052277 | A1 | 3/2011 | Ueno et al. | |
| 2014/0147183 | A1* | 5/2014 | Koshida | G03G 15/657 399/388 |
| 2014/0153938 | A1 | 6/2014 | Saito | |

FOREIGN PATENT DOCUMENTS

| | | | |
|---|---|---|---|
| JP | 2010-038967 | A | 2/2010 |
| JP | 2011-048051 | A | 3/2011 |
| JP | 2012-220758 | A | 11/2012 |
| JP | 2015-108686 | A | 6/2015 |

* cited by examiner

FIXING DEVICE

CROSS-REFERENCE TO RELATED APPLICATIONS

This application claims the benefit of Japanese Patent Application No. 2016-239247 filed on Dec. 9, 2016, which is hereby incorporated by reference herein in its entirety.

FIELD OF THE INVENTION AND RELATED ART

The present invention relates to a fixing device mountable to an image forming apparatus, such as a copying machine, a printer or a facsimile machine, for example, employing an electrophotographic type.

In a fixing device disclosed in Japanese Laid-Open Patent Application 2015-108686, a separation guide for preventing winding of a recording material, guided into the fixing device, without being separated from the fixing device is provided.

In such a fixing device, it has been known that at least one of a pair of rotatable members forming a nip in the fixing device is moved when a jam occurs to facilitate clearing the jam and thus these rotatable members are spaced from each other or are reduced in pressure therebetween. Further, in such a fixing device, it has been necessary to determine whether or not the jam clearance process (a process of removing the stagnating recording material by an operator) was properly carried out.

SUMMARY OF THE INVENTION

According to an aspect the present invention provides a fixing device including a first rotatable member, a second rotatable member, a moving mechanism, a flag, a sensor, a movable guide, and a stationary guide. The second rotatable member is configured to form a nip with the first rotatable member for fixing a toner image on a recording material. The moving mechanism is configured to move the first rotatable member in a direction away from the second rotatable member. The flag is provided downstream of the nip with respect to a recording material feeding direction and retractable with passing of the recording material. The sensor is configured to detect whether or not the flag is retracted by contact with the recording material. The movable guide is movable together with the first rotatable member away from the second rotatable member and from the flag by the moving mechanism. The movable guide is configured to guide the recording material on a side downstream of the nip with respect to the recording material feeding direction. The stationary guide is provided at such a fixed position that the stationary guide opposes the flag in the presence of the recording material in the fixing device, irrespective of a position of the movable guide member. The stationary guide is immovable together with the movable guide.

According to another aspect the present invention provides a fixing device including a first rotatable member, a second rotatable member, a moving mechanism, a flag, a sensor, and a movable guide. The second rotatable member is configured to form a nip with the first rotatable member for fixing a toner image on a recording material. The moving mechanism is configured to move the first rotatable member away from the second rotatable member. The flag is provided downstream of the nip with respect to a recording material feeding direction and retractable with passing of the recording material. The sensor is configured to detect whether or not the flag is retracted by contact with the recording material. The movable guide is movable together with the first rotatable member away from the second rotatable member and from the flag by the moving mechanism. The movable guide is configured to guide the recording material on a side downstream of the nip with respect to the recording material feeding direction. When the movable guide is in a state in which the movable guide is moved in the direction away from the flag, the flag and the movable guide are in an overlapping positional relationship with each other.

Further features of the present invention will become apparent from the following description of exemplary embodiments with reference to the attached drawings.

BRIEF DESCRIPTION OF THE DRAWINGS

Parts (a) and (b) of FIG. 1 are sectional views of a principal device part for illustrating an effect of a fixing device in Embodiment 1.

Figure 7:
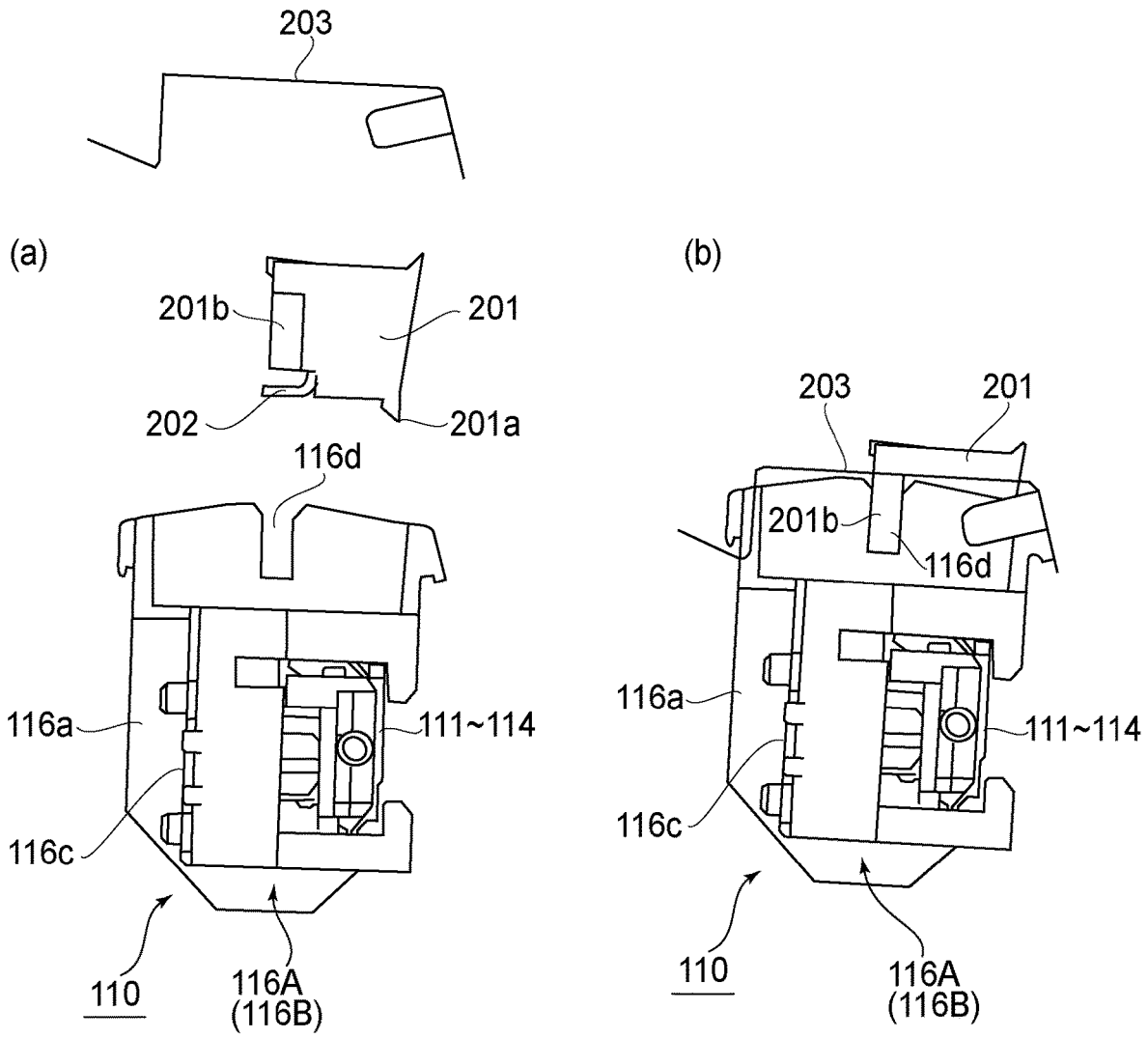

Parts (a) and (b) of FIG. 7 are illustrations of a constitution for mounting a separation guide to the belt unit.

Figure 8:
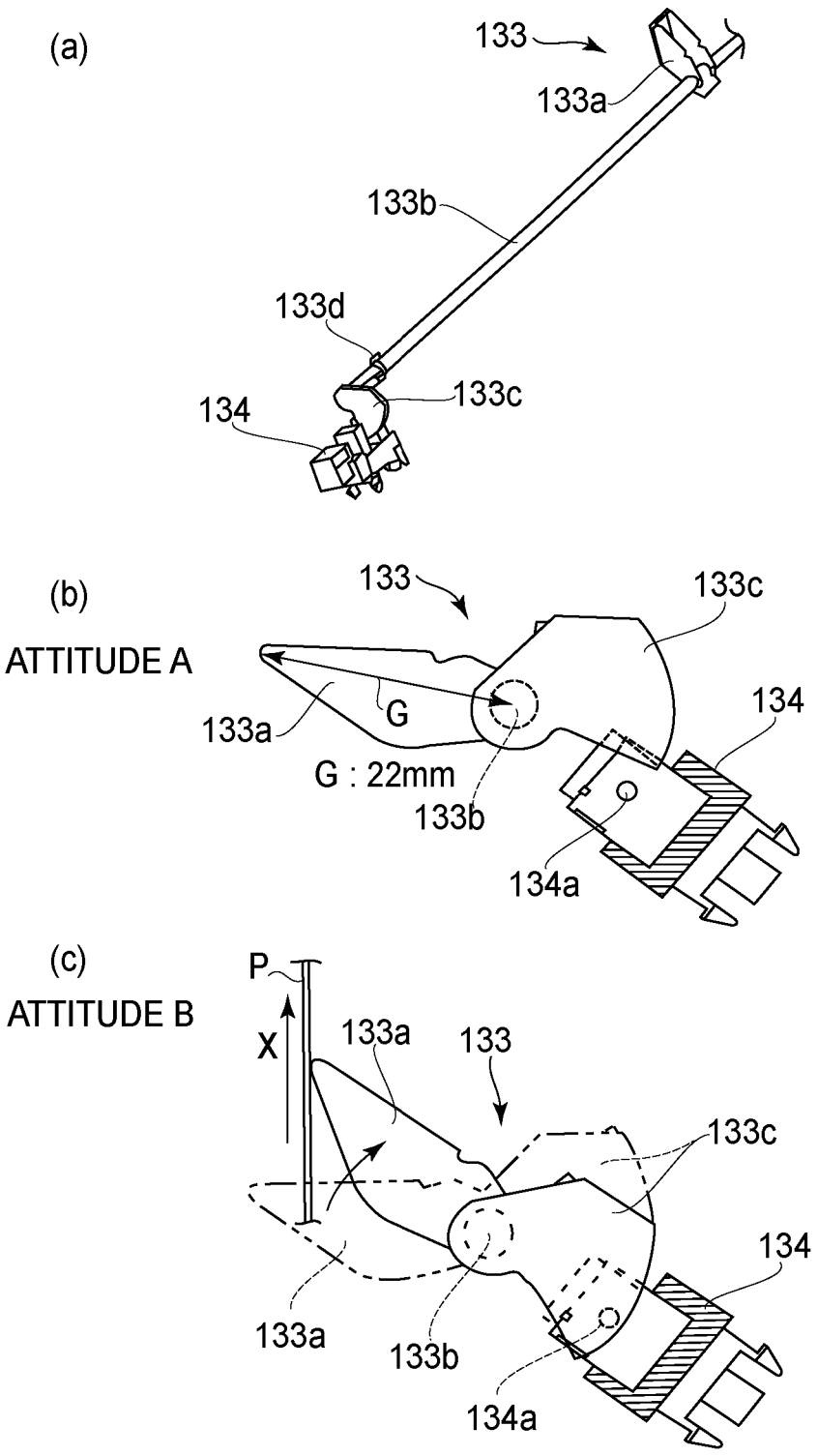

Parts (a) to (c) of FIG. 8 are illustrations of a sheet discharge sensor.

Figure 9:
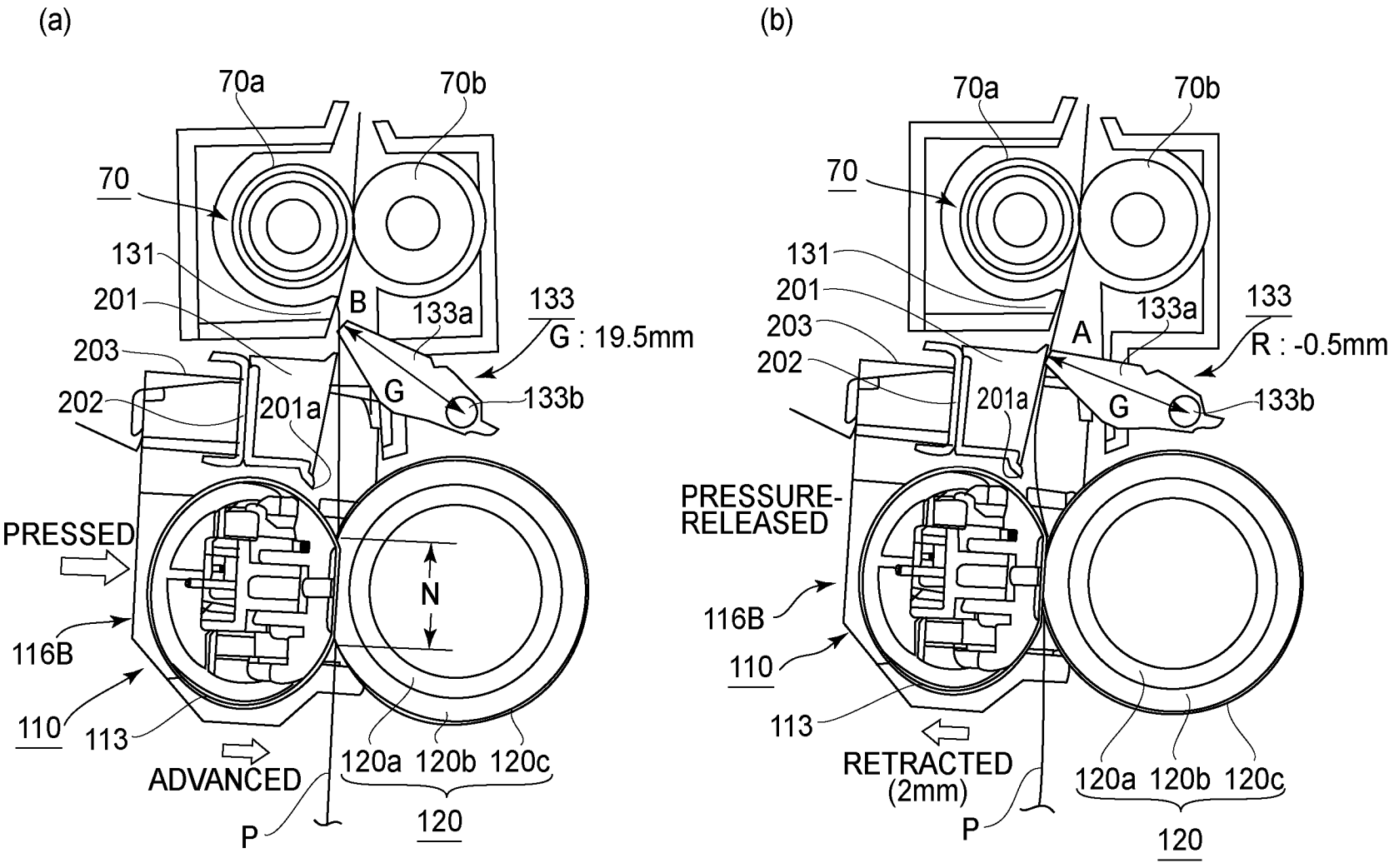

Parts (a) and (b) of FIG. 9 are illustrations of a principal part of a conventional fixing device.

Figure 10:
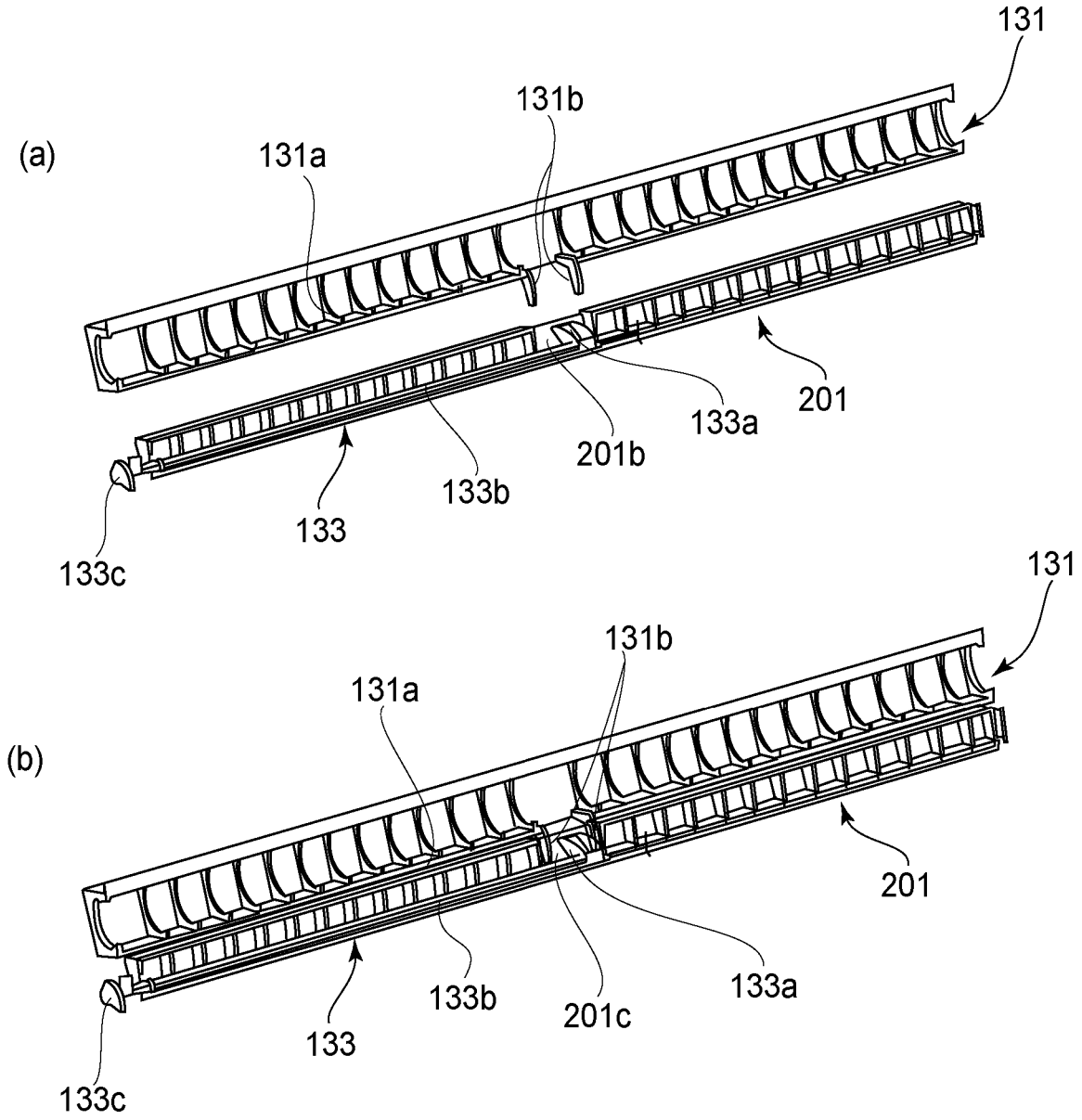

Parts (a) and (b) of FIG. 10 are schematic views for illustrating a separation guide, a sheet discharge guide and a sheet discharge sensor in a fixing device in Embodiment 2.

Figure 11:
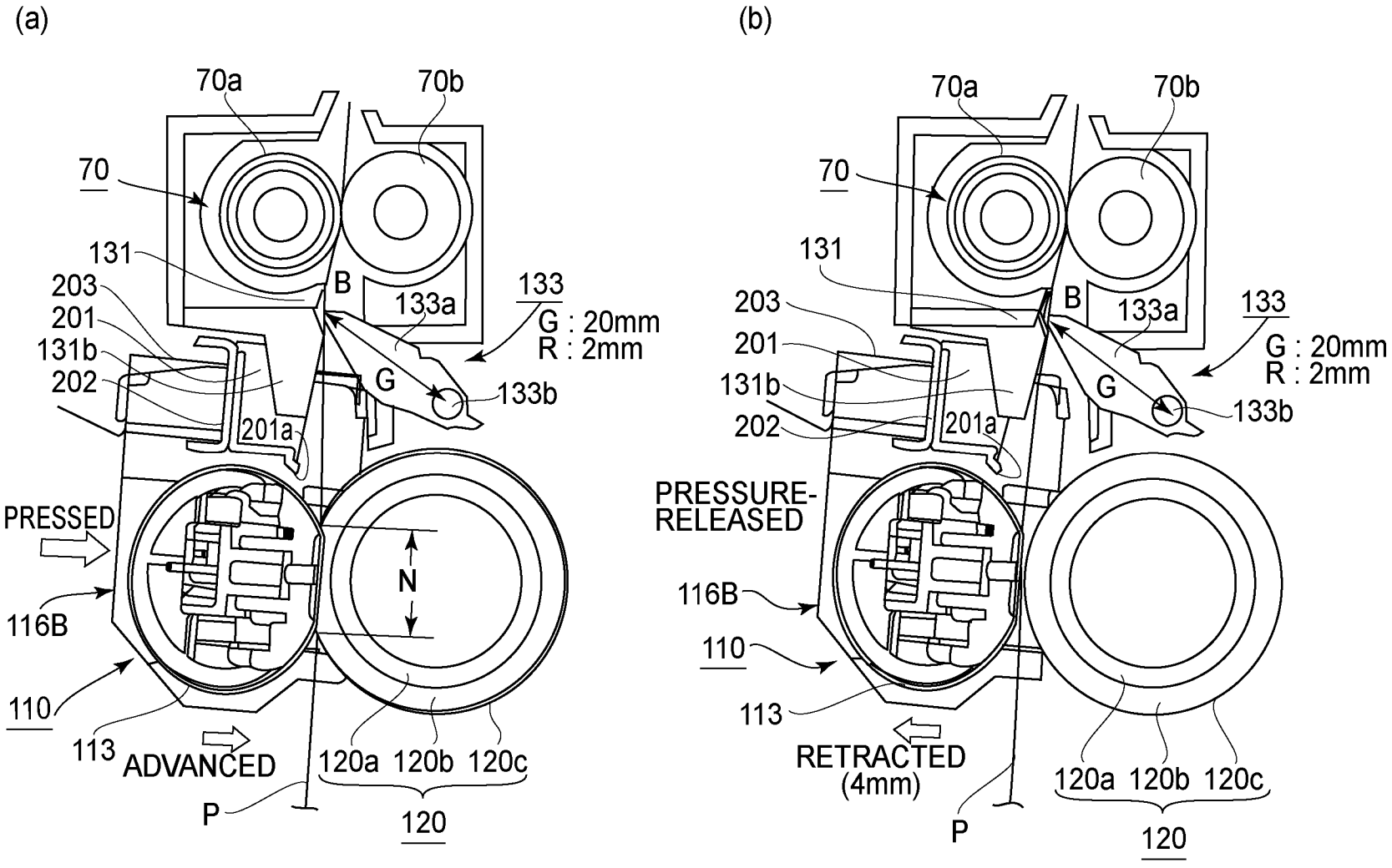

Parts (a) and (b) of FIG. 11 are sectional views of a principal device part of the fixing device for illustrating an effect of the fixing device in Embodiment 2.

Figure 12:
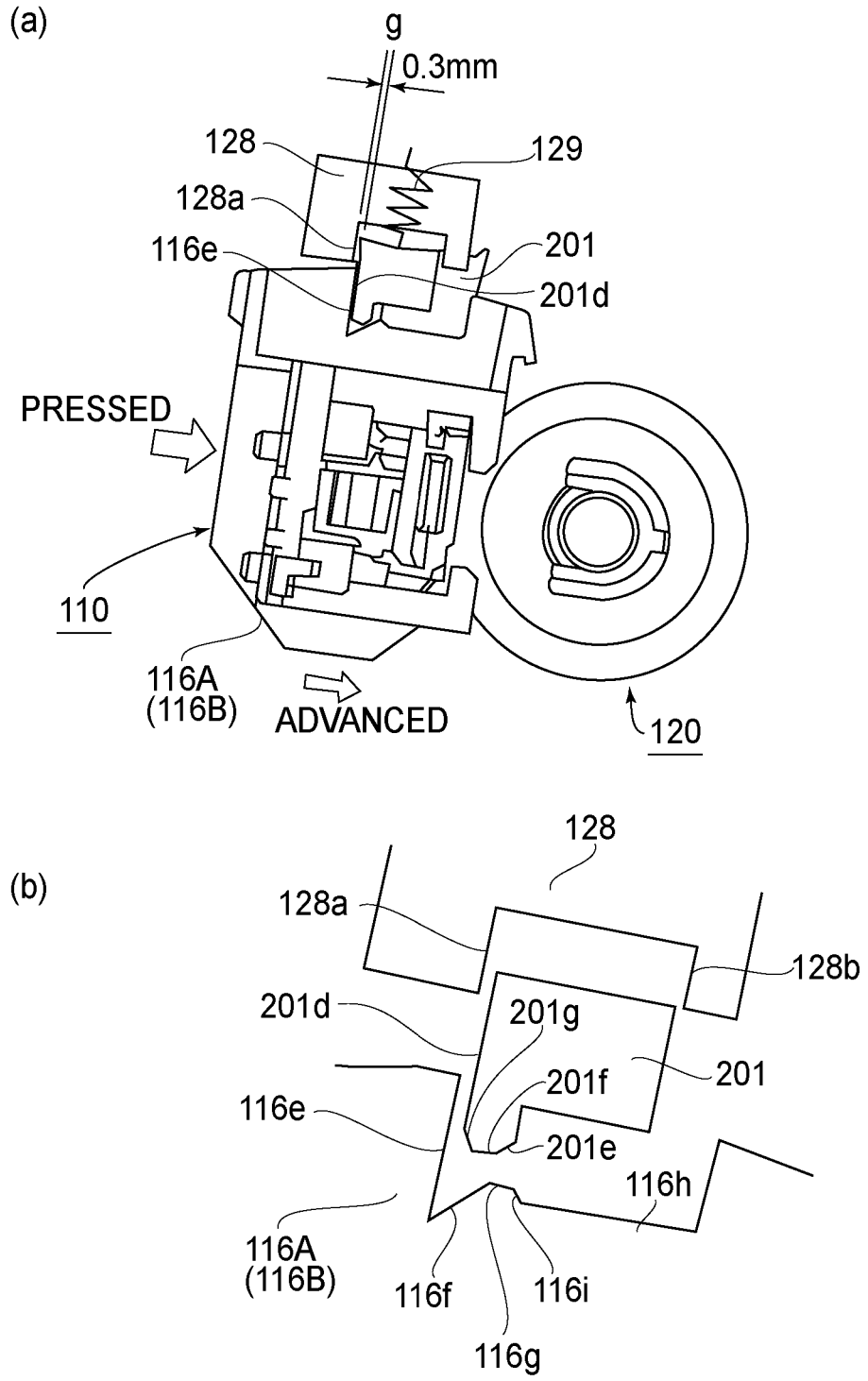

Parts (a) and (b) of FIG. 12 are schematic views for illustrating a separation guide and a flange member in a fixing device in Embodiment 3.

Figure 13:
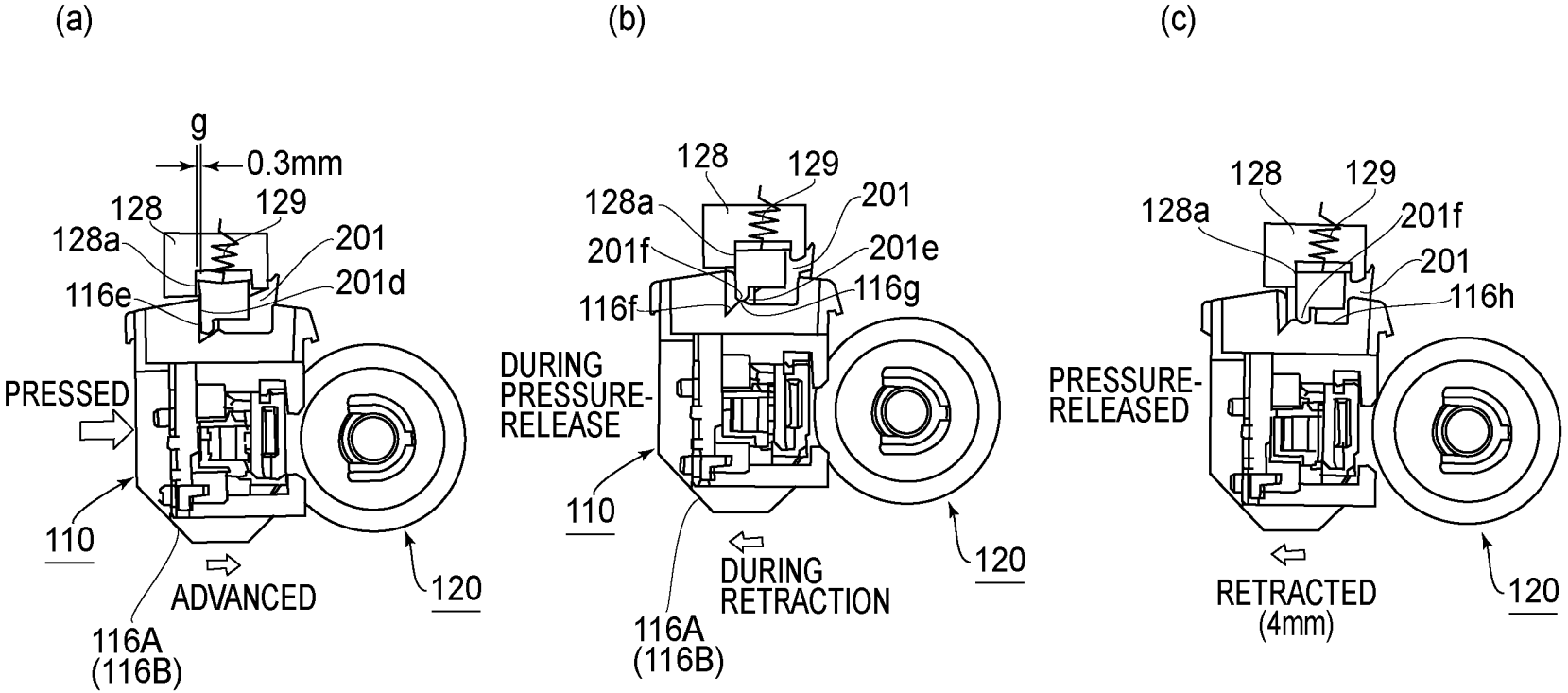

Parts (a) to (c) of FIG. 13 are schematic views for illustrating the separation guide and the flange member in the fixing device in Embodiment 3.

Figure 14:
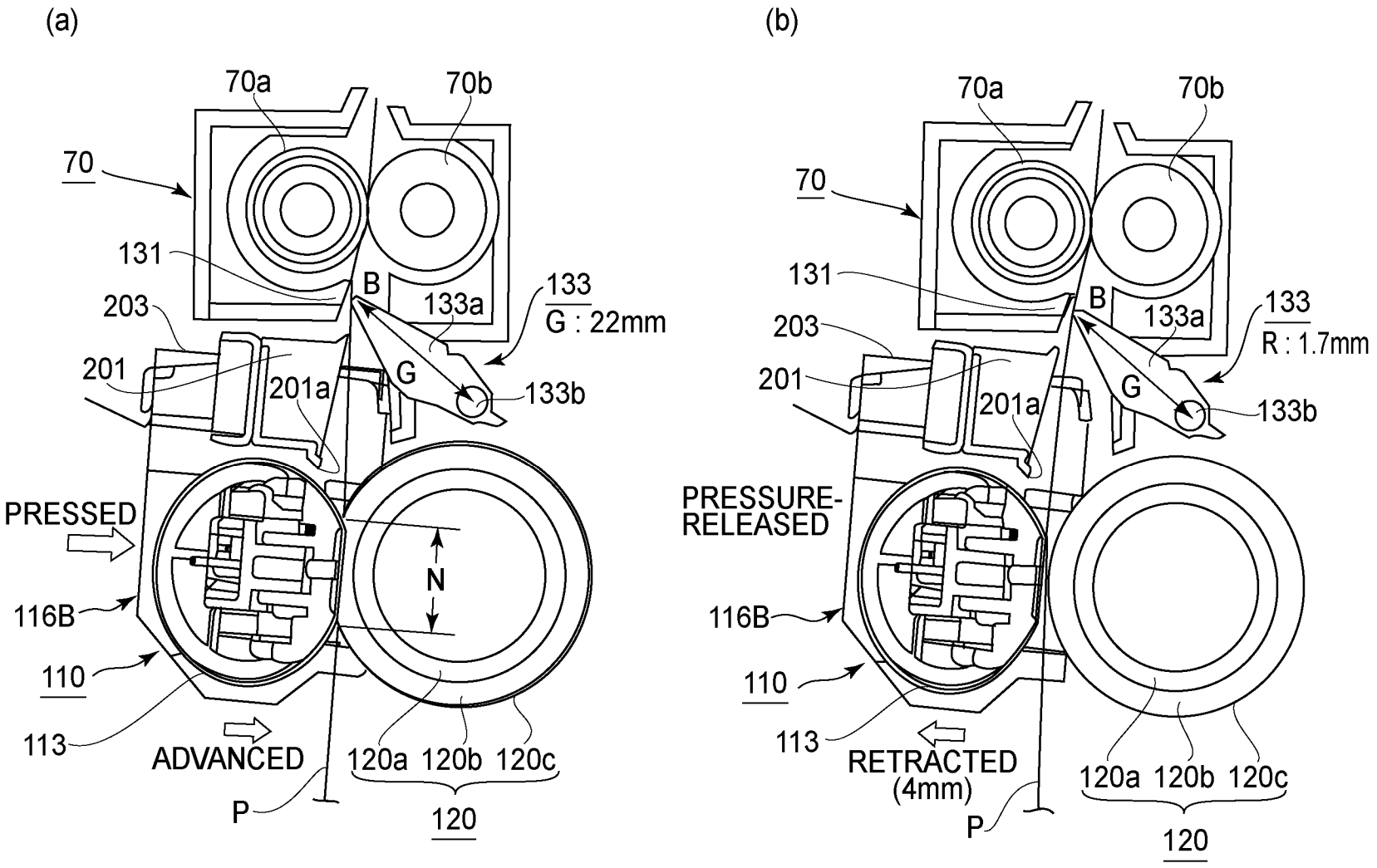

Parts (a) and (b) of FIG. 14 are sectional views of a principal device part for illustrating an effect of the fixing device in Embodiment 3.

DESCRIPTION OF EMBODIMENTS

Embodiments to which the present invention is applicable will be described with reference to the drawings, but can be variously modified within the scope of the concept of the present invention, and the present invention is not limited to the following embodiments.

Embodiment 1

(Printer)

Figure 2:
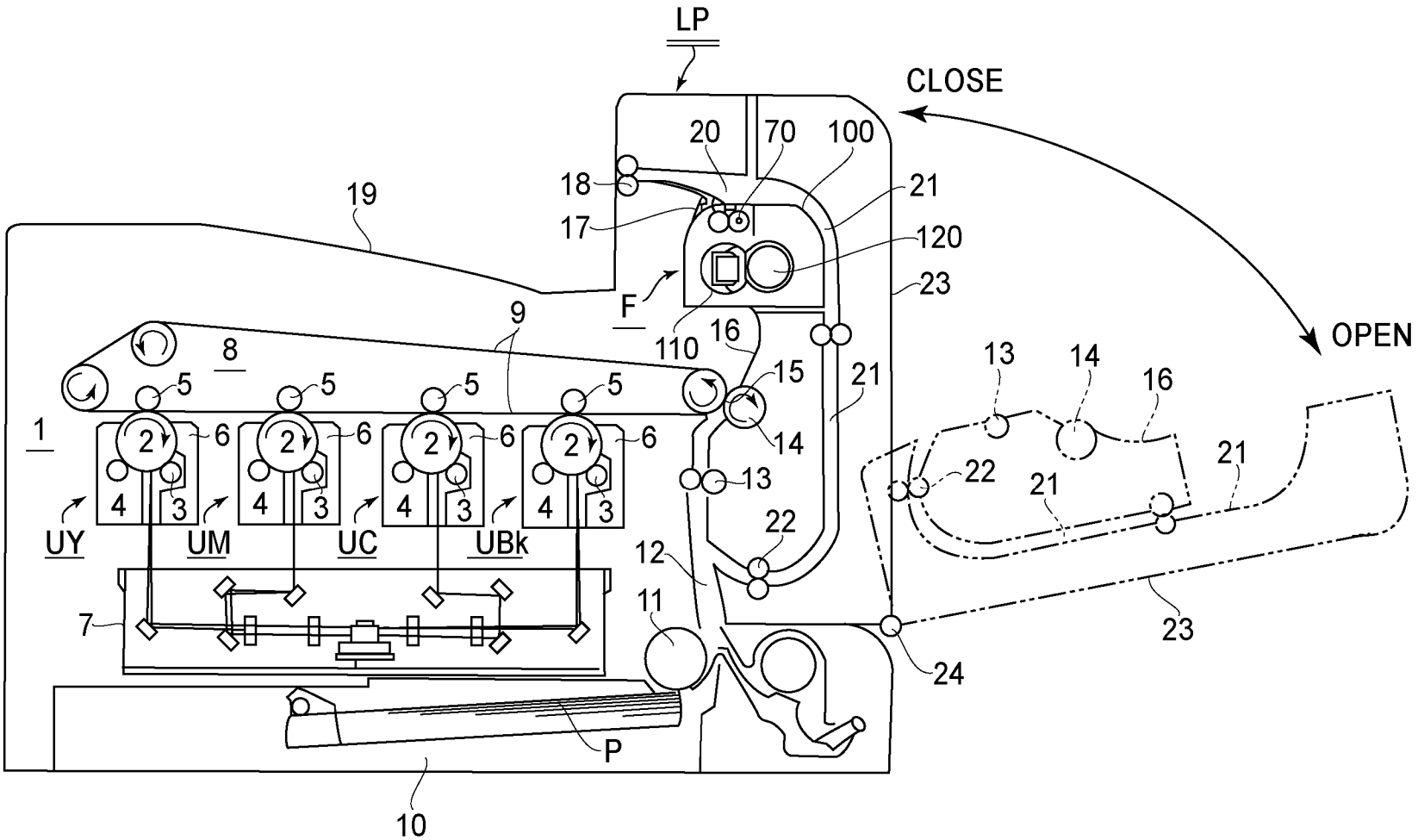
FIG. 2 is a schematic sectional view showing a general structure of an image forming apparatus in Embodiment 1.

FIG. 2 is a schematic sectional view of an image forming apparatus LP in this embodiment. The image forming apparatus LP is a tandem-type color printer using an electrophotographic process of a transfer type. The image forming apparatus LP forms and outputs a toner image on a recording material P (hereafter referred to as a sheet or paper). The toner image corresponds to image information inputted from a host device PC (FIG. 6) such as a personal computer to a controller (CPU) 300.

The image forming apparatus LP includes an image forming portion 1 for forming the toner image. The image forming portion 1 includes an image forming unit UY for forming a yellow (Y) toner image, an image forming unit UM for forming a magenta (M) toner image, an image forming unit UC for forming a cyan (C) toner image, and an image forming portion UBk for forming a black (Bk) toner image. The image forming apparatus LP further includes a laser scanner unit 7 and an intermediary transfer belt unit 8. Each of the image forming units U (Y, M, C, Bk) is an electrophotographic process mechanism and includes a photosensitive drum 2, a charger 3, a developing device 4, a primary transfer charger 5 and a photosensitive drum cleaner 6.

An electrophotographic process and an image forming operation of the image forming portion 1 having the above-described constitution are well known and therefore will be omitted from description. The respective color toner images are primary-transferred superposedly in a predetermined manner from the drums 2 of the respective image forming unit into an intermediary transfer belt 9. As a result, superposed color toner images of the four colors of Y, M, C and Bk are formed on the belt 9.

On the other hand, a single sheet P stacked and accommodated in a sheet (paper) feeding cassette 10 is separated and fed by driving a sheet feeding roller 11 and passes through a post-sheet feeding path 12, and then is sent to a registration roller pair 13. The registration roller pair 13 once receives the sheet P, and in the case when the sheet P is moved obliquely, the registration roller pair 13 rectifies the obliquely moved sheet P in a straight line. Then, the registration roller pair 13 sends the sheet P to a secondary transfer portion 15, which is a press-contact portion between the belt 9 and a secondary transfer roller 14, a synchronism with the color toner images on the belt 9. The four, color toner images are secondary-transferred altogether from the belt 9 onto the sheet P.

The sheet P passed through the secondary transfer portion 15 passes through a pre-fixing feeding path 16 and is guided from a downward entrance into a fixing device (fixing portion) F. The toner images are fixed as a fixed image by being heated and pressed by the fixing device F.

In the case of an operation in a one-side image forming mode, in which the toner images are formed (printed) only one surface (side) of the sheet P, the sheet P is fed upward from an upward exit of the fixing device F, is guided toward a sheet discharge roller 18 by a switching flapper 17, and is discharged (outputted) as a one-surface image-formed product onto a sheet discharge tray 19.

In the case of an operation in a double-side image forming mode in which the toner images are formed on both surfaces (sides) of the sheet P, the sheet P which came out of the fixing device F and on which the toner images have already been formed is fed toward the tray 19 by the sheet discharge roller 18, and, when a trailing end portion comes out of the fixing device F and reaches a reverse point 20, the sheet discharge roller 18 is reversely rotated. As a result, the sheet P is fed in a switch-back manner and is guided to a feeding path 21 for double-side printing.

Then, the sheet P passes through the feeding path 21 is re-guided into the post-sheet feeding path 12 in front of the registration roller pair 13 by a feeding roller 22 in a state in which the sheet P is turned upside down. Thereafter, the sheet P is subjected to the same process as that in the case of the operation in the one-side image forming mode and is discharged, as a double-side image-formed product on which the toner images are formed also on the other surface, onto the sheet discharge tray 19.

Incidentally, portions of the flapper 17 and the sheet discharge roller 18 subjected to the switch-back operation are an example of a reversing means. In this embodiment, the sheet P is reversed by the sheet discharge roller 18, but in order to enhance productivity of printing (image formation), the sheet P is reversed in a place other than the position of the sheet discharge roller 18 by, e.g., providing a reversing portion or a plurality of sheet discharge portions.

For the purpose of removing a jammed sheet when the sheet P caused a jam in the sheet feeding path inside the image forming apparatus, a main assembly of the image forming apparatus is provided with a door 23 so that the door 23 is rotatable (openable) rightward about a hinge 24 as a rotation center as indicated by a chain double-dashed line in FIG. 2. In FIG. 2, a right-side guide portion of the post-sheet feeding path, a right-side roller of the registration roller pair 13, the secondary transfer roller 14, the pre-fixing feeding path 16 and the feeding path 21 for double-side printing are provided on the door 23 side. Accordingly, the door 23 is opened, so that a sheet feeding path other than the fixing device F is opened in a path portion from the post-sheet feeding path 12 to the sheet discharge roller 18. As a result, removal of the jammed sheet can be easily carried out.

(Fixing Device)

Figure 3:
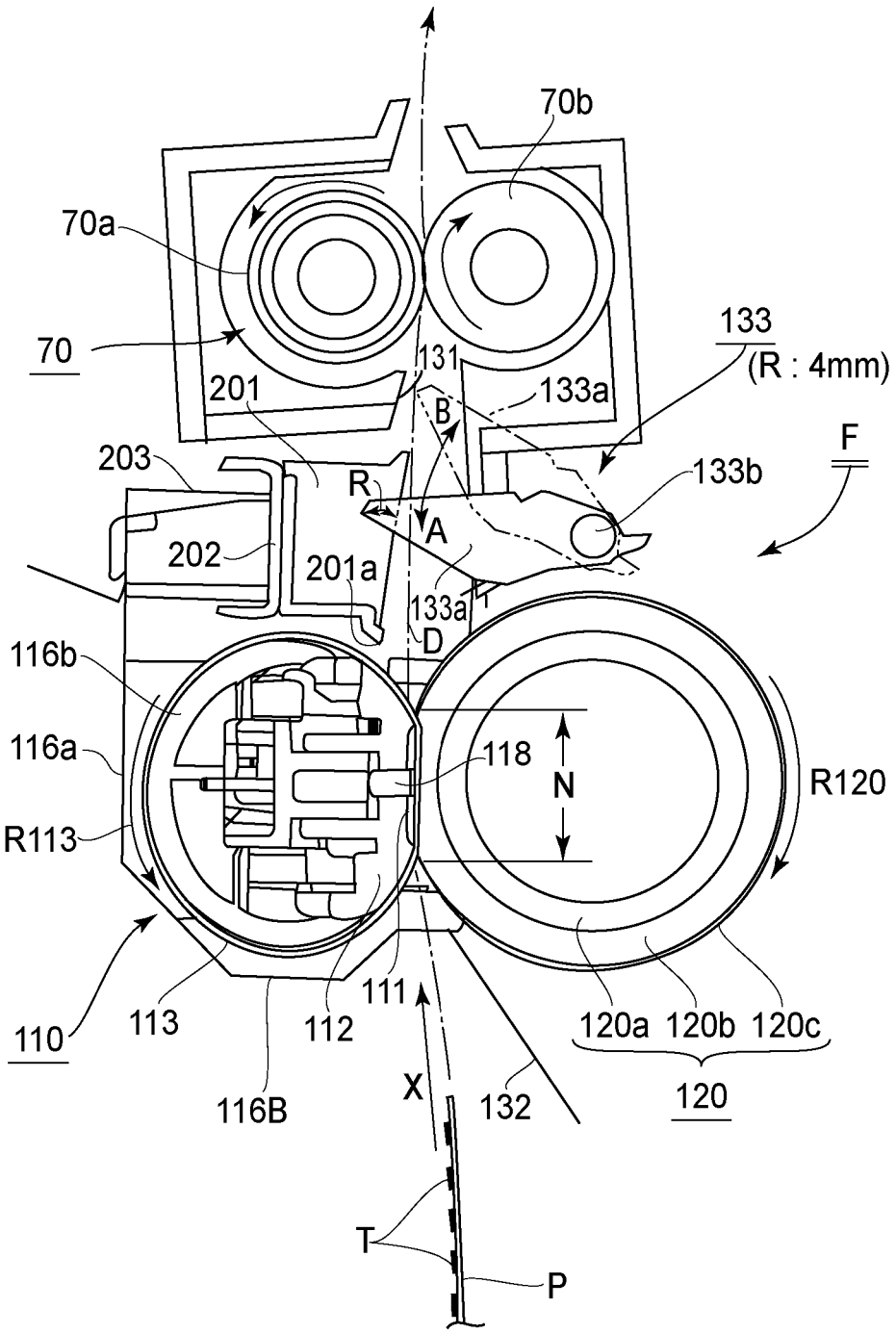
FIG. 3 is a sectional view of a principal part of the fixing device in Embodiment 1.
Figure 4:
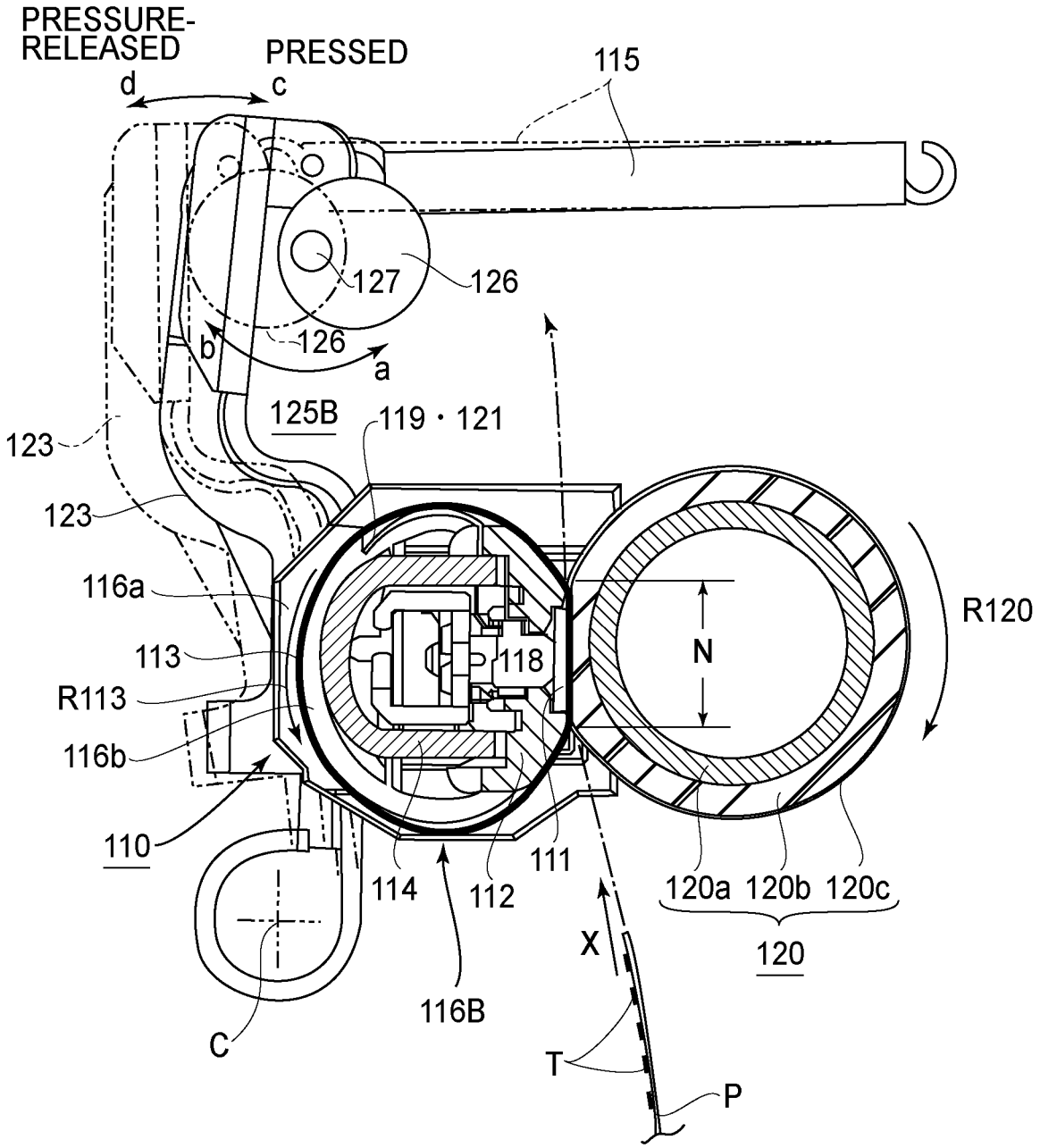
FIG. 4 is a schematic illustration of a pressing mechanism and a pressure-releasing mechanism of the fixing device.

FIG. 3 is a schematic cross-sectional view of a principal part of the fixing device F. FIG. 4 is an illustration of a pressing mechanism and a pressure-releasing mechanism. The fixing device F is an image heating apparatus of a belt heating type, and roughly includes the following members (1) to (6):

(1) a belt unit (heating device) 110 including a fixing belt (fixing film) 113 as a first rotatable member (fixing member, rotatable heating member), (2) an elastic pressing roller 120 as a second rotatable member (pressing member, rotatable pressing member), (3) pressing mechanisms 125A and 125B for forming a nip (fixing nip) N between the fixing belt 113 and the elastic pressing roller 120 by causing the belt unit 110 and the elastic pressing roller 120 to press-contact each other, (4) pressure-releasing mechanisms (moving mechanisms) 126 and 127 for releasing (eliminating) pressures of the pressing mechanisms 125A and 125B, (5) an inner sheet discharge roller pair 70, and (6) a device casing (fixing frame) 100 (FIG. 2).

Figure 5:
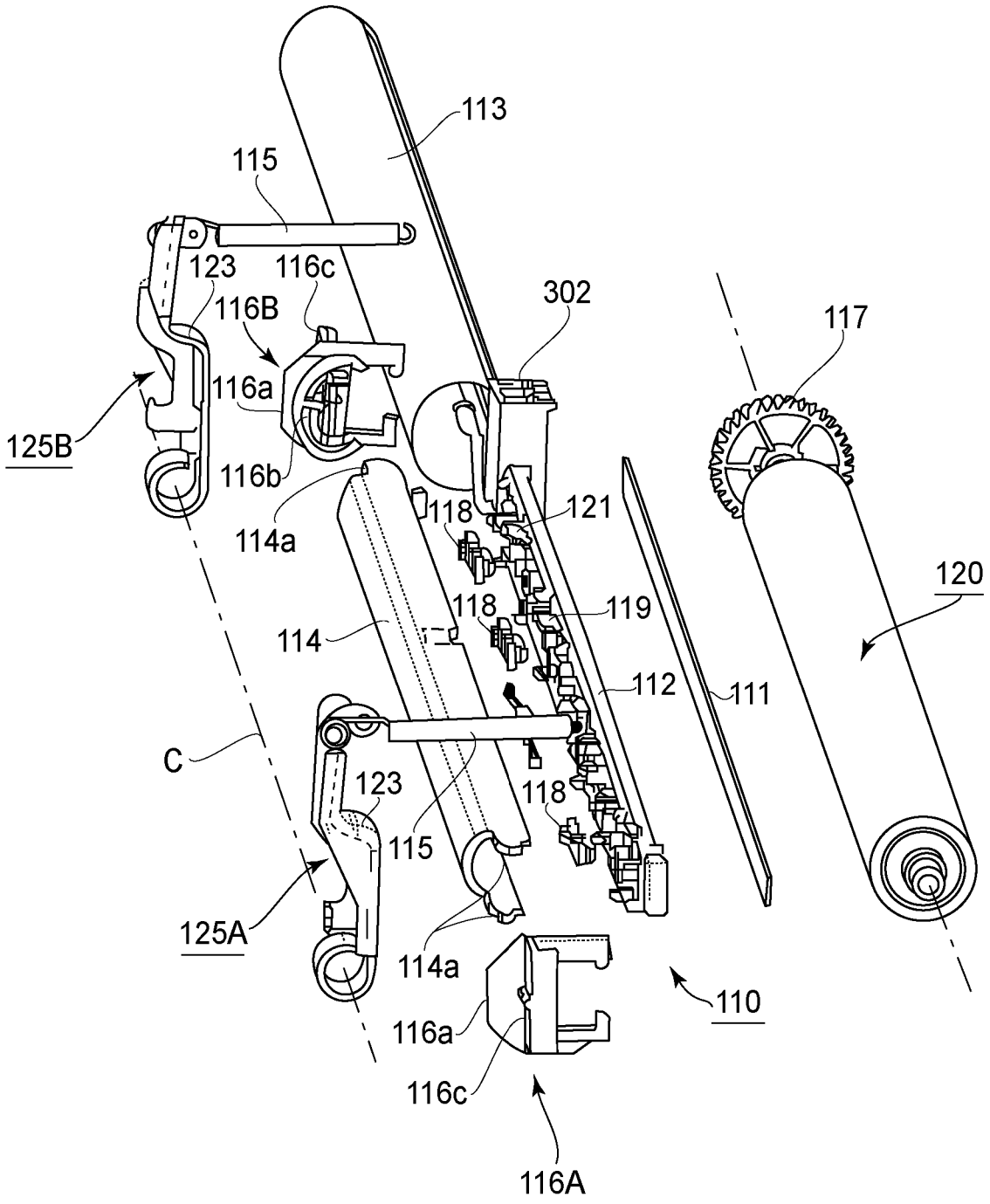
FIG. 5 is an exploded perspective view of a belt unit in the fixing device.

The nip N is a portion where the sheet P carrying thereon unfixed toner images T is nipped and fed and thus the toner images are fixed as a fixed image under application of heat and pressure. FIG. 5 is a schematic exploded perspective view of the belt unit 110, in which also pressing arms 123 and pressing springs 115 of the pressing mechanisms 125A and 125B and the elastic pressing roller (hereafter referred to as a pressing roller) 120 are illustrated together with the belt unit 110.

The belt unit 110 is an assembly of the cylindrical (endless) fixing belt (endless belt, hereafter referred to as a belt) 113, a heater 111, a heat-insulating holder 112, a metal stay 114, flange members 116A and 116B on one end side and the other end side, and the like.

The belt 113 is a thin heat-transfer (conduction) member having flexibility and heat-resistant property. For example, the belt 113 is a composite layer belt including a base layer of resin or metal, an elastic layer outside the base layer, and a surface parting layer, and assumes a substantially cylindrical shape by its own resilient property in a free state.

The heater 111 is a heating mechanism for the belt 113. In this embodiment, the heater 111 is a thin and elongated planar heat-generating member. The heater 111 has a low thermal capacity and is abruptly increased in temperature by energization. In this embodiment the heater 11 is a ceramic heater including a ceramic substrate provided with an energization heat-generating member (heat generating resistor generating heat by energization). The heat-insulating holder 112 is a heat-resistant resin mold having a substantially trough shape with a semicircular cross-section. The heat-insulating holder 112 is a long heat-insulating member extending along a widthwise direction (longitudinal direction) of the belt 113. The heater 111 is engaged in and held by a groove portion formed outside the holder 112 along the longitudinal direction.

The metal stay 114 is a rigid member that is long with respect to the widthwise direction of the belt 113 and not readily flexed, even when high pressure is applied thereto. In this embodiment, the stay 114 is a U-shaped metal mold member in cross section. The stay 114 is provided inside (a side opposite from the heater 111 side) the holder 112 and holds the holder 112.

The belt 113 is loosely and externally fitted abound an assembly of the above-described heater 111, holder 112, and stay 114. Both end portions 114*a* and 114*a* of the stay 114 protrude outward through openings at both end portions of the belt 113. With these stay end portions 114*a* and 114*a*, the flange members 116A and 116B are engaged, respectively, in a symmetrical manner. The flange member 116A and 116B are mold products of heat-resistant resin and are provided on one end side and the other end side.

The flange members 116A and 116B are regulating (limiting) members for regulating (limiting) longitudinal movement and circumferential shape of the belt 113 in the belt unit 110, and each includes a flange portion (flange sheet) 116*a*, a belt inner surface guide portion 116*b*, and a portion-to-be-urged 116*c*.

The flange portion 116*a* is a portion for receiving an end portion edge surface of the belt 113 and for preventing movement of the belt 113 in a thrust direction. The flange portion 116*a* has an outer shape larger than an outer shape of the belt 113. The belt inner surface operation portion 116*b* is provided inside the flange portion 116*a* in an arcuate shape and holds an inner surface of the belt end portion and thus maintains a cylindrical shape of the belt 113 (i.e., supports a rotational orbit of the belt 113). The portion-to-be-urged 116*c* is provided outside the flange portion 116*a* and receives a predetermined pressure (pressing force) from the pressing arm 123 of the pressing mechanism 125A (125B).

The holder 112 is provided with a temperature detecting element such as a thermistor 118 for detecting a rear surface temperature of the ceramic substrate of the heater 111 and is provided with a temperature detecting element such as a thermistor 119 for directly detecting an inner surface temperature of the belt 113. The metal stay 114 is provided with a grounding means 121 for the purpose of establishing a ground for the belt 113. The grounding means 121 and the thermistor 119 are mounted so as to protrude toward an outside of a projection shape with a spring property during belt mounting in a natural state so that the means 121 and 119 slide and contact to the belt inner surface in a state in which the belt 113 is mounted.

The pressing roller 120 is an elastic roller prepared by forming a heat-resistant elastic layer 120*b* in a roller shape on an outer peripheral surface of a core metal 120*a* so as to be concentrically integral with the core metal 120*a*. The pressing roller 120 includes a parting layer 120*c* as a surface layer. The pressing roller 120 is rotatably supported through bearing members (not shown) between side plates (not shown) of a device casing 100 on one end side and the other end side of the core metal 120*a*. On the other end side of the core metal 120*a*, a driving gear 117 is provided concentrically integral with the core metal 120*a*.

Figure 6:
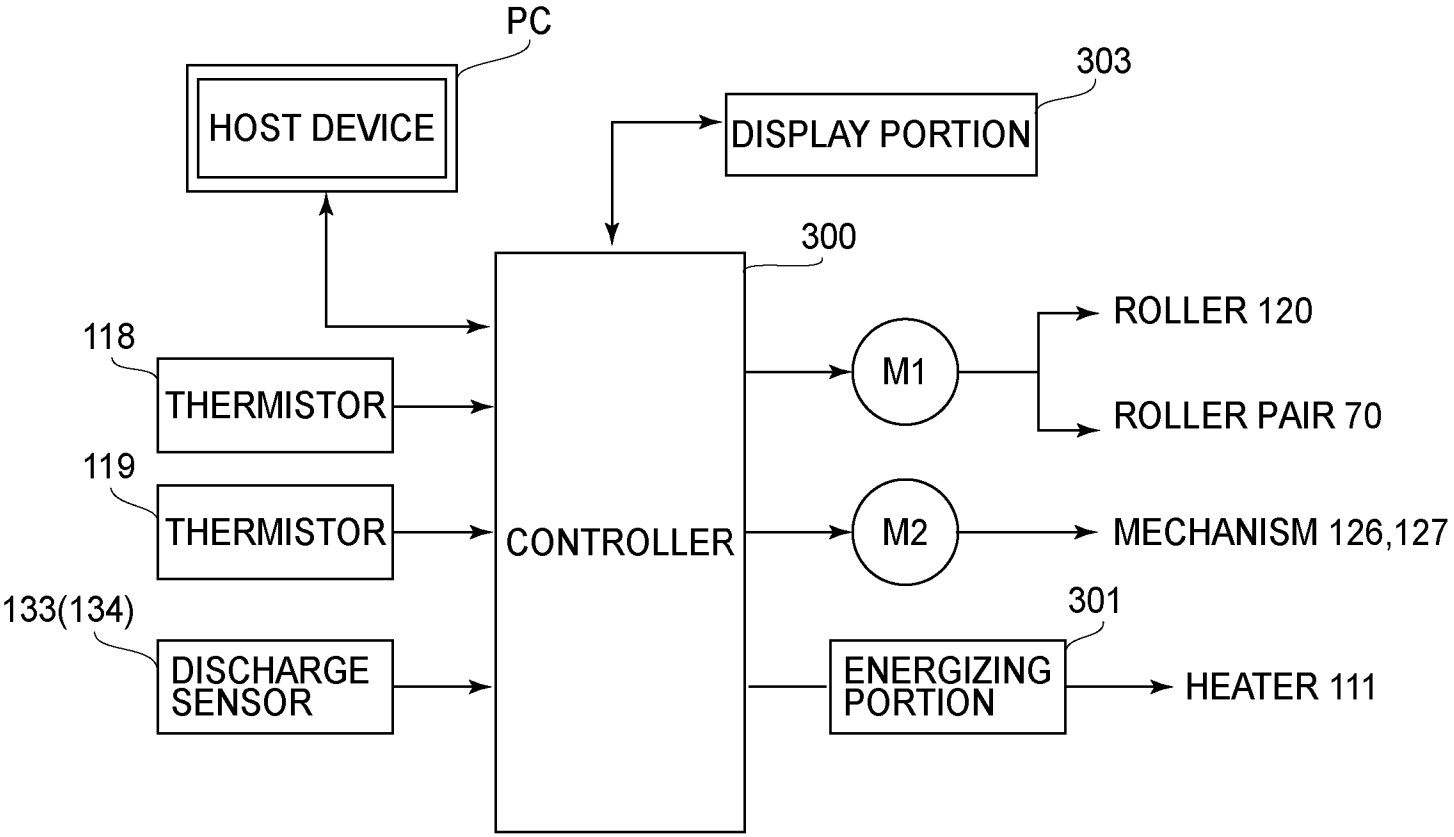
FIG. 6 is a block diagram of a control system of the image forming apparatus.

The pressing roller 120 is rotationally driven at a predetermined peripheral speed in the clockwise direction indicated by an arrow R120 in FIGS. 3 and 4 through transmission of a driving force, to the driving gear 117 via a drive transmitting mechanism (not shown), of a first driving motor M1 controlled by a controller 200 (FIG. 6).

The belt unit 110 is disposed substantially in parallel to the pressing roller 120 between the side plates of the device casing 100 on one end side and the other end side so that the heater 111 side thereof opposes the pressing roller 120. The flange members 116A and 116B of the belt unit 110 on one end side and the other end side are mounted slidably (movably) (i.e., are capable of moving forward and rearward) in directions of movement toward and away from the pressing roller 120 relative to the side plates of the device casing 100 on one end side and the other end side.

To the portions-to-be-urged 116*c* of the flange members 116A and 116B, a predetermined pressure for moving the flange members 116A and 116B toward the pressing roller 120 is applied by the pressing mechanisms 125A and 125B on one end side and the other end side.

As a result, the stay 114, the holder 112 and the heater 111 are pressed toward the pressing roller 120. For that reason, the holder 112 and the heater 111 are pressed against the belt 113 toward the pressing roller 120 against elasticity of the elastic layer 120*b* with a predetermined pressure so as to compress the pressing roller 120. As a result, between the belt 113 and the pressing roller 120, the nip N is formed with a predetermined width with respect to a sheet feeding direction (recording material feeding direction) X.

The pressing mechanisms 125A and 125B on one end side and the other end side have the same constitution and each includes the pressing arm 123 and the pressing spring 115. The pressing arm 125 of each of the pressing mechanism 125A on one end side and the pressing mechanism 125B on the other end side is held rotatably about a rotation center C by the device casing 100 at one end portion thereof. At the other end portion of the pressing arm 123, one end portion of the pressing spring 115 is locked, and the other end portion of the pressing spring 115 is locked to a locking portion (not shown) of the device casing 100.

The pressing spring 115 is a tension spring. By a tensile force of this spring 115, the pressing arm 123 of each of the pressing mechanisms 125A and 125B on one end side and the other end side is press-contacted to the portion-to-be-urged 116*c* of the associated one of the flange members 116A and 116B on one end side and the other end side with the predetermined pressure.

The pressure releasing mechanisms (moving mechanisms) 126 and 127 are mechanisms for releasing (eliminating) the pressure of the pressing mechanisms 125A and 125B, and include a pressure releasing cam 126 and a cam shaft 127. The cam 126 is provided on each of the pressing mechanisms 125A and 125B on one end side and the other end side, and these cams 126 are the same-shaped eccentric cams fixed, at the same phase, to a common cam shaft 127 rotatably supported between the side plates of the device casing 100 on one end side and the other end side. The cam shaft 127 is rotated by transmitting thereto a rotational force of a second driving motor M2, via a drive transmitting mechanism (not shown), controlled by the controller 300.

In FIG. 4, the first rotation angle attitude a of the cam 126 is indicated by a solid line and a second rotation angle attitude b of the cam 126 is indicated by a chain double dashed line. The controller 300 changes the attitude of the cam 126 between the first rotation angle attitude a and the second rotation angle attitude b by controlling the rotation angle of cam shaft 127. A small protruded portion opposes the pressing arm 123 when the cam 126 is positioned in the first rotation angle attitude a and a large protruded portion opposes the pressing arm 123 when the cam 126 is positioned in the second rotation angle attitude b.

In a state in which the attitude of the cam 126 is changed to the first rotation angle attitude a, the cam 126 is in non-contact with the pressing arm 123 and thus does not interfere with the pressing arm 123. For that reason, the pressing arms 123 of the pressing mechanisms 125A and 125B on one end side and the other end side are in a pressing position c in which the pressing arms 123 are press-contacted to the portions-to-be-urged 116*c* of the flange members 116A and 116B on one end side and the other end side with the predetermined pressure as indicated by the solid line. The cams 126 are usually held in the first rotation angle attitude a. That is, the belt unit 110 and the pressing roller 120 are held in a press-contact state by the pressing mechanisms 125A and 125B, so that the nip N having the predetermined width is formed between the belt 113 and the pressing roller 120.

In a state in which the attitude of the cam 126 is changed to the second rotation angle attitude b, the large protruded portion contacts the pressing arm 125. For that reason, the pressing arm 123 is rotated and retracted about the rotation center c against the tensile force of the pressing spring 115 in a direction of being moved away from the portion-to-be-urged 116*c* of the associated one of the flange members 116A and 116B, and is held at a pressure releasing position d indicated by a chain double-dashed line.

As a result, the cams 126 receive the pressure from the pressing springs 115, so that the pressure applied to the flange members 116A and 116B can be reduced or eliminated. That is, the press-contact between the belt unit 110 and the pressing roller 120 is substantially released (eliminated), so that the nip N is in a state in which the members 110 and 120 are spaced from each other or the press contact (nip pressure) is released (eliminated).

The inner sheet discharge roller pair 70 is provided in a side downstream, with respect to the sheet feeding direction X, of the nip N formed by the belt 113 and the pressing roller 120. The inner sheet discharge pair 70 relays the sheet P coming out of the nip N and then feeds and discharges the sheet P from the fixing device F. The inner sheet discharge roller pair 70 is constituted by a driving roller 70*a* and a follower roller 70*b*. The driving roller 70*a* is rotatably provided via bearing members between the side plates of the device casing 100 on one end side and the other end side. The follower roller 70*b* is pressed against the driving roller 70*a* by an urging member (not shown) and thus a nip for nipping and feeding the sheet P. The follower roller 70*b* is rotated by rotational drive of the driving roller 70*a*.

The driving roller 70*a* includes a driving gear (not shown) provided concentrically with a shape end portion thereof and is rotationally driven in the sheet discharge direction by transmitting the driving force of the first driving motor M1 to the driving gear 70*a* via a drive transmitting mechanism (not shown). In order to suitably maintain the attitude of the sheet P to be fed, the inner sheet discharge roller pair 70 is rotated by setting a rotational speed thereof to be faster than a rotational speed of the pressing roller 120 by about 0-5%. Further, the inner sheet discharge roller pair 70 is desirably positioned as close to the nip N to as possible. This is because the sheet P discharged from the nip N is maintained in a suitable attitude as soon as possible and thus a quality of a product is improved. At a sheet feeding path portion D between the nip N and the inner sheet discharge roller pair 70, a sheet discharge detecting mechanism 133 is provided. The sheet discharge detecting mechanism 133 also performs a function of discriminating whether or not the sheet P is removed (i.e., detection of a removal-forgotten jammed paper) in the case when the sheet P jammed in a side downstream of the nip N with respect to the sheet feeding direction.

At the sheet feeding path portion D, a separation guide (movable guide) 201 of the sheet P and a sheet discharge guide (stationary guide, stationary (fixing) portion, opposing portion) 131 are provided. The sheet P discharged from the nip N is guided by a guide portion of the separation guide 201 and then is guided by the sheet discharge guide 131 provided downstream of the separation guide 201 with respect to the sheet feeding direction X.

(Fixing Operation)

A fixing operation of the fixing device F is as follows. The controller 300 drives the first driving motor M1 at predetermined control timing of image forming sequence control. As a result, the pressing roller 120 is rotationally driven. Further, also the inner sheet discharge roller pair 70 is in a rotation state.

With the rotational drive of the pressing roller 120, the belt 113 is rotated (moved) in the counterclockwise direction, indicated by an arrow R113, by a frictional force with the pressing roller 120 at the nip N. At this time, an inner surface of the belt 113 slides on the heater 111 in the nip N while hermetically contacting the heater 111 in the nip N. Between the belt 113 and the heater 111, a lubricant such as heat-resistant grease of a fluorine-containing material or a silicone-containing material is interposed, so that a frictional resistance can be reduced to a low level and thus the belt 113 is rotatable (movable) smoothly.

The movement of the rotating belt 113 in the thrust direction is prevented by the flange portions 116*a* and 116*a* of the flange members 116A and 116B. The rotation of the belt 113 is guided (i.e., a rotation orbit is supported) by the holder 112 and the guide portions 116*b* and 116*b* of the flange members 116A and 116B.

Further, the controller 300 starts energization from an energization portion (electric power supplying portion, power source portion) 301 to the heater 111 via a wiring portion (not shown) and an energization socket 302 (FIG. 5). As a result, the heater 111 generates heat and abruptly increases in temperature. A temperature of the heater 111 is detected by the thermistor 118 provided on a rear surface of the ceramic substrate and detected temperature information is fed back to the controller 300. Further, an inner surface temperature of the belt 113 heated by the heater 111 is detected by the thermistor 119 and detected temperature information is fed back to the controller 300.

On the basis of the detected temperature information from the thermistors 118 and 119, the controller 300 controls electric power supplied from an energization portion 301 to the heater 111 so that the temperature at the nip N is maintained at a predetermined desired fixing set temperature. Specifically, the controller 300 causes the heater 111 to increase in temperature to a predetermined temperature and controls the temperature of the heater 111 by determining and properly controlling a duty ratio, wave number, or the like of a voltage applied to an energization heat generating resistance layer of the heater 111.

The sheet P, which is fed from the image forming portion 1 toward the fixing device F and which carries thereon the unfixed toner images T, is guided into the nip N along an entrance guide 132 and then is heated and pressed while being nipped and fed. As a result, the toner images T are fixed as a fixed image on the sheet P. The sheet P coming out of the nip N is guided by the separation guide 201 and then is further guided by the sheet discharge guide 131 provided downstream of the separation guide 201 with respect to the sheet feeding direction. Then, the sheet P is relayed and fed by the inner sheet discharge roller pair 70 and is sent from the fixing device F.

(Separation Guide)

The separation guide (first recording material feeding guide) 201 will be described with reference to FIGS. 3 and 7. Parts (a) and (b) of FIG. 7 are side views of the belt unit 110 and the separation guide 201 in one end side. Part (a) of FIG. 7 is an exploded view of the belt unit 110 and the separation guide 201, and part (b) of FIG. 7 is an assembly view of the belt unit 110 and the separation guide 201.

The sheet P, as shown in FIG. 3, is nipped and fed through the nip N by the rotating belt 113 of the belt unit 110 and the pressing roller 120. Then, in a feeding process of the sheet P, the toner images T are heat-fixed on the sheet P under application of heat and pressure. Even when the sheet P adheres to the surface of the belt 113 due to heat-fusing (melting) of the toner images T at the nip N and is fed with the rotation of the belt 113, a leading edge (leading end) of the sheet P coming out of the nip N abuts against a fee end 201*a* of the separation guide 201. As a result, the sheet P is separated from the surface of the belt 113.

Therefore, the separation guide 201 is disposed downstream of the nip N with respect to the sheet feeding direction X with a minute gap between the belt surface layer and the free end 201*a* in view of the rotation orbit of the belt so as to prevent winding of the sheet P about the belt 113 and to prevent damage of the belt due to contact of the sheet P with the belt.

In this embodiment, resin materials PBT+ABS are used as a material of the separation guide 201. The separation guide 201 is fixed to a metal frame 202 by an unshown fastening means such as a screw, so that thermal expansion and warpage, or the like, occurred during molding of the separation guide 201 are rectified. In this embodiment, iron is used as a material of the metal frame 202.

In order to ensure the gap between the belt 113 and the free end 201*a* of the separation guide 201 with accuracy, in this embodiment, a constitution as shown in FIG. 7 is employed. That is, longitudinal engaging portions of the separation guide 201 on one end side and the other end side are engaged with separation guide holding portions 116*d* of the flange members 116A and 116B disposed on one end side and the other end side of the belt unit 110. The engaging portions 201*b* on one end side and the other end side are fixed to the flange members 116A and 116B by separation guide urging springs 203, respectively.

This is because the separation guide 201 can be directly positioned to the flange members 116A and 116B which regulate the rotation orbit of the belt 113 on one end side and the other end side. By employing the above-described constitution, in this embodiment, a width of a gap between the belt 113 and the free end 201*a* of the separation guide 201 can be maintained at about 0.3 mm.

That is, in this embodiment, the separation guide 201 is disposed downstream of the nip N with respect to the sheet feeding direction X with a predetermined gap from the belt 113. In addition, the separation guide 201 is positioned to and supported by the component parts 116A and 116B on the belt 113 side.

In this embodiment, in order to further enhance the accuracy, the engaging portions 201*b* as opposing members to the separation guide holding portions 116*d* of the flange members 116A and 116B are provided on the separation guide 201, but engaging portions may also be provided on the metal frame 202 for rectifying the separation guide 201.

(Sheet Discharge Detecting Mechanism)

A sheet discharge detecting mechanism 133 will be specifically described with reference to FIGS. 3 and 8. In this embodiment, detection of the sheet P in the fixing device F is carried out in the sheet feeding path portion D between the nip N and the inner sheet discharge roller pair 70. The sheet detection is performed by the sheet discharge detecting mechanism 133 and a photo-sensor 134 for detecting a phase of the sheet discharge detecting mechanism 133. Part (a) of FIG. 8 is a perspective view showing the sheet discharge detecting mechanism 133 and the photo-sensor 134, and parts (b) and (c) of FIG. 8 are side views showing a relationship between the sheet discharge detecting mechanism 133 and the photo-sensor 134.

The sheet discharge detecting mechanism (flag) 133 of a rotary type is constituted by a contact portion 133*a* to which the sheet P coming out of the nip N is contacted, a light-blocking portion 133*c* for light-blocking a sensor (photointerruptor) 134, and a holding portion 133*b* for holding the contact portion 133*a* and the light-blocking portion 133*c*. In this embodiment, the holding portion 133*b* is a shaft rod. A base portion of the contact portion 133*a* is fixed and mounted to a longitudinal central portion of the shaft rod 133*b*, and a base portion of the flag portion (light-blocking portion) 133*c* is fixed and mounted on one end side of the shaft rod 133*b*. The type of the sheet discharge detecting mechanism 133 is not limited to such a type as to swing in the rotational direction, but may also be a type in which the sheet discharge detecting mechanism 133 retracts in a linear direction (retractable type).

The shaft rod 133*b* is disposed substantially in parallel to the separation guide 201 on a side opposite from the separation guide 201 with respect to the sheet feeding path portion D and is rotatably supported via bearing members between the side plates of the device casing 100 on one end side and the other end side. That is, the contact portion 133*a* and the light-blocking portion 133*c* are disposed rotatably about the shaft rod 113*b*. The contact portion 133*a* and the light-blocking portion 133*c* are always rotationally urged in the counterclockwise direction in FIG. 3 about the shaft rod 133*b* by a torsion spring (urging member) 133*d*.

In a state in which there is no sheet, the contact portion 133*a* is kept in a state in which the contact portion 133*a* is rotated by an urging force of the spring 133*d* and falls to an attitude A indicated by a solid line in FIG. 3, and further movement of the contact portion 133*a* is prevented by a stopper (not shown). In this state, the contact portion 133*a* crosses the sheet feeding path portion D, and the free end portion thereof overlaps with the guide portion of the separation guide 201 in an overlapping amount R. The above-described rotation angle attitude A of the contact portion 133*a*, i.e., the sheet discharge detecting mechanism 133, is a sheet absence detection attitude.

The sensor (photo-interrupter) 134 is fixed at a predetermined position to an immovable member (not shown) in the detection attitude casing 100 side and includes a light source portion 134*a* and a light-receiving portion (not shown) opposing the light source portion 134*a*.

When the contact portion 133*a* is in the sheet absence detection attitude A, a phase of the light-blocking portion 133*c* is in a phase in a state in which an optical path between the light source portion 134*a* and the light-receiving portion of the sensor 134 is open (light transmission) as shown in part (b) of FIG. 8. In this state, the sensor 134 outputs an ON signal, and the ON signal is inputted to the controller 300. The controller 300 discriminates that there is no sheet in the fixing device F.

On the other hand, when the sheet P is guided into the fixing device F and the leading end portion of the sheet P coming out of the nip N reaches and contacts the contact portion 133*a*, the contact portion 133*a* is pushed toward the inner sheet discharge roller pair 70 by a subsequent feeding force of the sheet P. Then, the contact portion 133*a* is rotated about the shaft rod 133*b* in the clockwise direction in FIG. 3 against the urging force of the spring 133*d*, so that the attitude of the contact portion 133*a* is changed from the attitude A to an attitude B in which the contact portion 133*a* is retracted toward a downstream side of the sheet feeding direction as indicated by a chain double-dashed line in FIG. 3. In this state, the sheet P passes through between the sheet discharge guide 131 and the free end of the contact portion 133*a* and is relayed and fed by the inner sheet discharge roller pair 70.

The above-described rotation angle attitude B of the contact portion 133*a* is a sheet presence detection attitude. The sheet presence detection attitude B is held until the trailing end portion of the sheet P ends passing thereof through between the sheet discharge guide 131 and the free end of the contact portion 133*a*.

When the contact portion 133*a* is in the sheet presence detection attitude B, the phase of the light-blocking portion 133*c* is a phase in a state in which the optical path between the light source portion 134*a* and the light receiving portion of the sensor 134 is blocked (light-blocked). In this state, the sensor 134 outputs an OFF signal, and the OFF signal is inputted to the controller 300. The controller 300 discriminates presence of the sheet (paper) P in the fixing device F on the basis of the OFF signal.

Thereafter, when the trailing end of the sheet P ends the passing thereof through between the sheet discharge guide 131 and the free end of the contact portion 133*a*, the sheet discharge detecting mechanism 133 is in a free state. For that reason, the sheet discharge detecting mechanism 133 is rotated about the shaft rod 113*b* by the urging force of the spring 133*d*, so that the attitude of the contact portion 133*a* is returned from the sheet presence detection attitude B to the sheet absence detection attitude A. For that reason, the output signal of the sensor 134 is switched from the OFF signal to the ON signal. As a result, the controller 300 discriminates that the sheet P is discharged from the fixing device F and the sheet discharge detecting mechanism 133 is in a sheet absence state.

That is, the sheet discharge detecting mechanism 133 detects the presence or absence of the sheet P by being swung by the contact or non-contact of the sheet P with the contact portion 133. Thus, the sheet discharge detecting mechanism 133 detects whether or not the sheet P discharged through the nip N is properly fed.

Further, the sheet discharge detecting mechanism 133 also has a function (remaining sheet (paper) detection) of discriminating whether or not the sheet P is removed in the case when the sheet P caused a jam in a side downstream of the nip N with respect to the sheet feeding direction. That is, in the case when the sheet P caused the jam in the side downstream of the nip N with respect to the sheet feeding direction, the sheet discharge detecting mechanism 133 is maintained in the sheet presence detection attitude B by the jammed sheet (sheet presence detection). By removal of the jammed sheet, the attitude of the sheet discharge detecting mechanism 133 is returned to the sheet absence detection attitude A.

In the case when the jam of the sheet P generates in the nip N, it is desirable that the sheet discharge detecting mechanism detects the jam early and the device operation is shut down in an emergency. In this embodiment, diameters of the belt 113 and the pressing roller 120 are set at about 30 mm, and the sheet discharge detecting mechanism 133 is disposed so that the sheet discharge detecting mechanism 133 is capable of detecting arrival of the sheet P at a position of about 15 mm from the nip N.

As described above, the contact portion 133*a* of the sheet discharge detecting mechanism 133 is disposed in an overlapping manner such that the contact portion 133*a* has the overlapping amount R with the guide portion of the separation guide 201. In this embodiment, a distance G (part (b) of FIG. 8) from the free end of the contact portion 133*a* to a center of the holding portion 133*b* is set at about 22 mm. As a result, when the sheet discharge detecting mechanism 133 is in the sheet absence detection attitude A, the free end of the contact portion 133*a* overlaps with the separation guide 201 with the overlapping amount R of about 4 mm.

Further, also when the sheet discharge detecting mechanism 133 is in the sheet presence detection attitude B (during the feeding of the sheet P), a constitution in which the free end of the contact portion 133*a* overlaps with the separation guide 201 with the overlapping amount R of about 2 mm is employed. This will be described later.

(Spacing/Depressurization Constitution During Jam Generation)

Details of constitution of spacing or depressurization of the nip N during jam generation (occurrence) of the sheet P will be specifically described. In this embodiment, in the case when the sheet P jammed in the fixing device F, a jam clearance property is enhanced by lowering a nip pressure in the nip N.

The jam detection of the sheet in the image forming apparatus LP is carried out using a known technique (such as sheet passing sensor for detecting passing/delay of sheet (not shown)). During the jam generation, the controller 300 shuts down the operation of the image forming apparatus LP in an emergency. Then, the controller 300 causes a display portion 303 (FIG. 6) to display a jam generation position (portion) and prompts an operator to remove the jammed sheet (jam clearance). The jam clearance is, as described above, performed by opening the door 23 of the image forming apparatus LP (as indicated by the chain double-dashed line in FIG. 2). The jam generation or remaining sheet detection in the fixing device F is carried out on the basis of continuous input of the OFF signal of the photo-sensor 134 due to abnormal continuation of the sheet presence detection attitude B of the sheet discharge detecting mechanism 133.

In this embodiment, during the jam generation, the controller 300 stops the device operation of the image forming apparatus LP including the fixing device F in the emergency. In the fixing device F, the pressure releasing mechanisms 126 and 127 are operated, so that the pressing forces of the pressing mechanisms 125A and 125B to the belt unit 110 are released.

That is, the controller 300 drives the second motor M2 and rotates the cam shaft 127 of the pressure releasing (126, 127), so that the attitude of the cam 126 is switched from the first rotation angle attitude a indicated by the solid line of FIG. 4 to the second rotation angle attitude b indicated by the chain double-dashed line of FIG. 4. As a result, the pressing arm 123 is moved from a pressing position c indicated by the solid line to a pressure-released position d indicated by the chain double-dashed line and is held at the pressure-released position d. As a result, the press-contact of the belt unit 110 with the pressing roller 120 is released (eliminated), so that the pressure (pressing force) applied to the nip N can be reduced or eliminated.

Accordingly, the sheet P jammed in a state in which the sheet P is nipped in the nip N in the fixing device F is easily removed by being pulled out, so that the jam clearance property can be enhanced.

In this embodiment, the pressure applied to the nip N is reduced or eliminated (i.e., the belt 110 and the pressing roller 120 are in a spaced state) by releasing the press-contact of the belt unit 110 with the pressing roller 120, so that a thickness of the elastic layer 120*b* of the pressing roller 120 compressed in the nip N against elasticity is restored. By this thickness restoring force of the elastic layer 120*b*, the belt unit 110 is pressed, so that the belt unit 110 is moved together with the separation guide 201 in a direction (retracting direction) of being moved away from the pressing roller 120.

In this embodiment, a retraction amount (movement amount) of the pressing arm 123 is set at about 2.0 mm. At this time, the belt unit 110 retracted from the pressing roller 120 is in a state in which the pressure applied to the pressing roller 120 is substantially zero or the belt unit 110 is contacted to the pressing roller 120 with a light pressure.

In this embodiment, the pressing arm 123 is not positively fixed to the flange members 116A and 116B. For that reason, a retraction amount (movement amount) of the belt unit 110 does not coincide with the retraction amount of the pressing arm 123 in some cases. A constitution in which the pressing arm 123 and the flange members 116A and 116B are engaged and integrally moved with each other may also be employed, and the spacing/depressurization constitution described in this embodiment does not limit the scope of the present invention. The pressure applied to the pressing roller 120 by the movement of the belt unit 110 may only be required to be reduced, and naturally, the belt unit 110 and the pressing roller 120 may also be in a spaced state.

The operator closes the door 23 after the jam clearance. When the door 23 is closed, a main switch of the image forming apparatus is turned on again. At this time, when the controller 300 carries out the sheet detection and there is no remaining sheet, the controller 300 resumes the device (apparatus) operation. As regards the fixing device F, the state of the belt unit 110 relative to the remaining roller 120 is returned from the pressure-released state to the pressed state. In the case when the controller 300 detects the remaining sheet, the controller 300 causes the display portion 303 to display a remaining sheet position (portion) and then prompts the operator to remove the remaining sheet.

(Effect of Execution of this Embodiment)

In this embodiment, a relationship constitution of "(overlapping amount between separation guide 201 and free end of contact portion 133*a* of sheet discharge detecting mechanism 133 during feeding of sheet P)>(retraction amount of belt 133 (belt unit 110) and separation guide 201 by pressure-releasing mechanism)" is employed. As a result, it is possible to prevent t the contact portion 133*a* from remaining standing although the jammed sheet still remains.

An effect of execution of this embodiment will be described using FIGS. 1 and 9. Parts (a) and (b) of FIG. 1 are schematic views showing a state in which the sheet P jammed in the nip N in the case when this embodiment is carried out, i.e., when the overlapping amount R between the separation guide 201 and the free end of the contact portion 133*a* of the sheet discharge detecting mechanism 133 is 4.0 mm (FIG. 3), in which part (a) of FIG. 1 shows the pressed state of the belt unit 110 against the pressing roller 120, and part (b) of FIG. 1 shows the state in which the pressure is released and the belt unit 110 and the separation guide 201 are retracted from the pressing roller 120 by 2.0 mm.

Parts (a) and (b) of FIG. 9 are schematic views of a comparison example in which this embodiment is not carried out. In the comparison example, a distance G from a free end of a contact portion 133*a* of a sheet discharge detecting mechanism 133 to a center of a holding portion 133*b* is set at about 19.5 mm.

That is, parts (a) and (b) of FIG. 9 are schematic views showing a state in which the sheet P jammed in the nip N in the case when this embodiment is not carried out, i.e., when the overlapping amount R between the separation guide 201 and the free end of the contact portion 133*a* of the sheet discharge detecting mechanism 133 is 1.5 mm, in which part (a) of FIG. 9 shows the pressed state of the belt unit 110 against the pressing roller 120, and part (b) of FIG. 9 shows the state in which the pressure is released and the belt unit 110 and the separation guide 201 are retracted from the pressing roller 120 by 2.0 mm.

Figure 1:
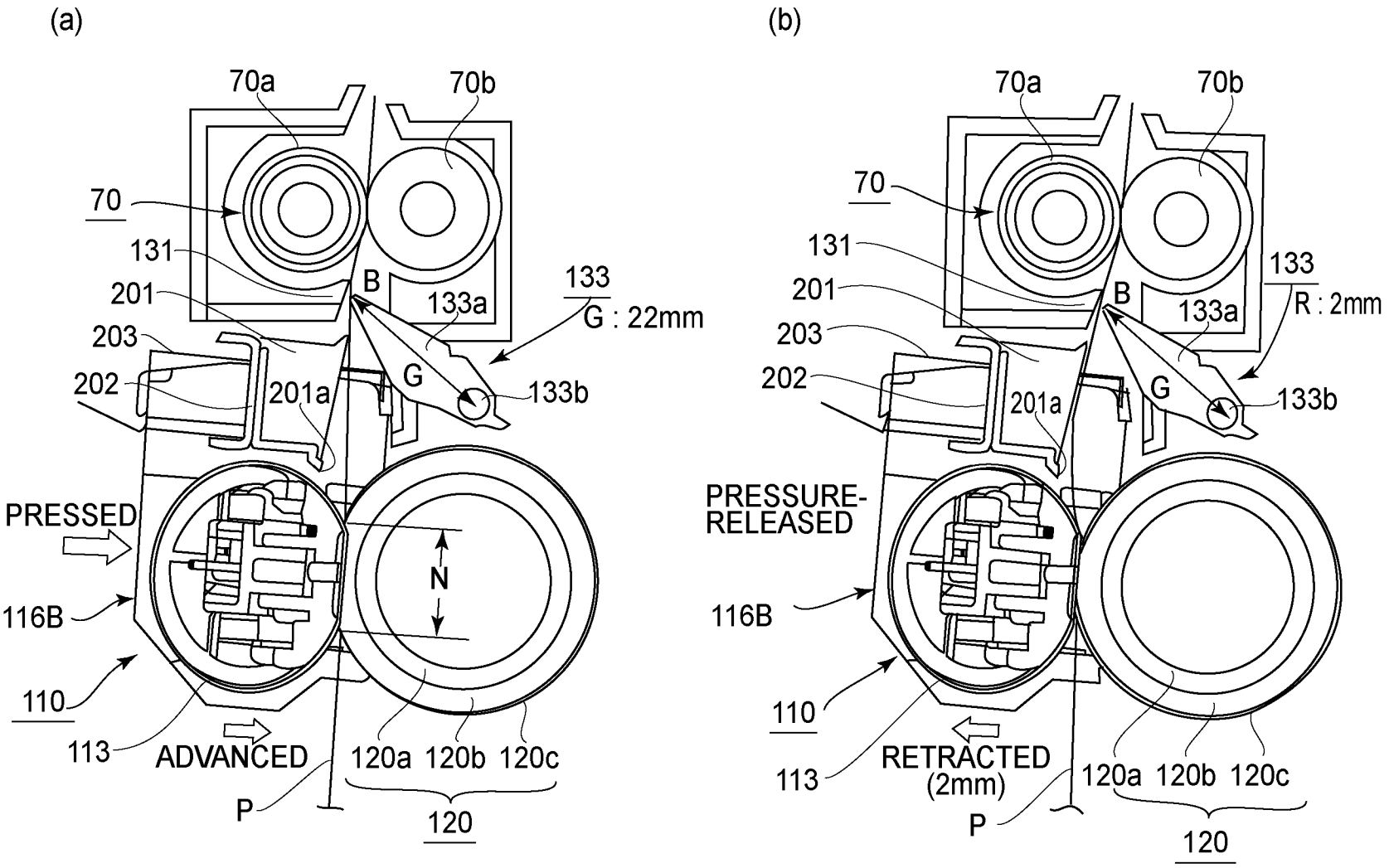

In this embodiment shown in FIG. 1, as shown in part (b) of FIG. 1, even when the belt unit 110 and the separation guide 201 are retracted by 2.0 mm, the overlapping amount R of 2.0 mm is ensured between the separation guide 201 and the free end of the contact portion 133*a* of the sheet discharge detecting mechanism 133. That is, (overlapping amount before retraction: 4.0 mm)−(retraction amount: 2.0 mm)=(overlapping amount after retraction: 2.0 mm). Accordingly, until the sheet P is removed, the sheet discharge detecting mechanism 133 is rotated, and the sheet discharge detecting mechanism 133 is in the "sheet presence detection attitude B", so that the remaining sheet detection can be carried out.

On the other hand, in the case of FIG. 9 showing the comparison example, as shown in part (b) of FIG. 9, when the belt unit 110 and the separation guide 201 are retracted by 2.0 mm, the overlapping amount between the separation guide 201 and the free end of the contact portion 133*a* of the sheet discharge detecting mechanism 133 is eliminated, so that the gap therebetween is 0.5 mm. That is, (overlapping amount before retraction: 1.5 mm)−(retraction amount: 2.0 mm)=(overlapping amount after retraction: −0.5 mm).

Accordingly, in the case when, for example, a sheet P, such as ultrathin paper, having low rigidity (weak stiffness) jammed, the sheet P enters the gap of 0.5 mm between the separation guide 201 and the contact portion 133*a* of the sheet discharge detecting mechanism 133. For that reason, before the sheet P is removed, the sheet discharge detecting mechanism 133 is in the "sheet absence detection attitude A" in some cases. That is, "passing of sheet P through sensor" generates. As a result, there is a possibility that the operator such as a user does not recognize the presence of the sheet P.

Accordingly, by carrying out this embodiment, the relationship constitution of "(overlapping amount between separation guide 201 and free end of contact portion 133*a* of sheet discharge detecting mechanism 133)>(retraction amount of belt 110 (belt unit 110) and separation guide 201) is employed. As a result, it is possible to prevent the "passing of sheet P through sensor" with reliability.

Embodiment 2

Embodiment 2 will be described. In Embodiment 2, many constitutions are the same as those in Embodiment 1, and therefore, in the following, the constitutions different from Embodiment 1 will be principally described. Explanation of the general structure of the printer and a schematic explanation of the fixing device are common to Embodiments 1 and 2.

(Separation Guide)

The different constitution from Embodiment 1 will be described using FIG. 10. Parts (a) and (b) of FIG. 10 are perspective views of the sheet discharge detecting mechanism 131 and the separation guide 201, in which part (a) of FIG. 10 shows an exploded perspective view, and part (b) of FIG. 10 shows an assembly perspective view.

The separation guide 201 includes a partially retraction guide 201*c* with respect to the longitudinal direction perpendicular to the sheet feeding direction. The contact portion 133*a* of the sheet discharge detecting mechanism 133 opposes this partially retraction guide 201*c*.

(Discharging Sheet Guide)

A constitution of the sheet discharge guide 131 will be described also using FIG. 10. The sheet discharge guide 131 forms the guide portion 131*a* of the sheet P on a side downstream of the separation guide 201 with respect to the sheet feeding direction. The sheet discharge guide 131 includes opposite guide portions 131*b* on a side upstream of the guide portion 131*a* with respect to the sheet feeding direction. The opposite guide portions 131*b* are disposed so as to overlap with the retraction guide portion 201*c* of the separation guide 201 with respect to the sheet feeding direction. With the opposite guide portions 131*b*, the contact portion 133*a* of the sheet discharge detecting mechanism 133 is disposed so as to overlap. That is, the sheet discharge guide 131 is fixedly disposed on a side downstream of the separation guide 201 with respect to the sheet feeding direction X, and the parts 131*b* thereof overlap with the separation guide 201 with respect to the sheet feeding direction. The separation guide 201 includes a shaped portion 201*c* for retracting the parts 131*b* of the sheet discharge guide 131.

(Sheet Discharge Sensor)

The sheet discharge sensor has the same constitution as that in Embodiment 1. In this embodiment, the distance from the free end of the contact portion 133*a* to the center of the holding portion 133*b* is set at about 20 mm. As a result, during the feeding of the sheet P, the free end of the contact portion 133*a* overlaps with the opposite guide portions 131*b* of the sheet discharge guide 131 by about 2 mm.

(Spacing/Depressurization Constitution During Jam Generation)

This constitution is common to Embodiments 1 and 2. In this embodiment, the retraction amount (movement amount) of the belt unit 110 was 4.0 mm.

(Effect of Execution of this Embodiment)

An effect of execution of this embodiment will be described using FIG. 11. Explanation in the case when this embodiment is not carried out (in the case of a comparison example) is the same as that in the comparison example (FIG. 9) for Embodiment 1, and therefore will be omitted.

Parts (a) and (b) of FIG. 11 are schematic views showing a state in which the sheet P jammed in the nip N in the case when this embodiment is carried out, i.e., when the overlapping amount R between the separation guide 201 and the free end of the contact portion 133*a* of the sheet discharge detecting mechanism 133 is 4.0 mm, in which part (a) of FIG. 11 shows the pressed state of the belt unit 110 against the pressing roller 120, and part (b) of FIG. 11 shows the state in which the pressure is released and the belt unit 110 and the separation guide 201 are retracted from the pressing roller 120 by 4.0 mm.

In this embodiment, the separation guide 201 retracts and moves together with the belt unit 110, but the sheet discharge guide 131 does not retract and therefore does not move. Accordingly, the opposite guide portions 131*a* of the sheet discharge guide 131 overlapping with the contact portion 133*a* of the sheet discharge detecting mechanism 133 maintain the overlapping amount of 2.0 mm even in a state in which the belt unit 110 and the separation guide 201 are retracted. That is, (overlapping amount: 2.0 mm)−(movement amount of opposite guide portions 131*b* during retraction of belt unit 110: 0.0 mm)=(overlapping amount after retraction: 2.0 mm).

Accordingly, until the sheet P is removed, the sheet discharge detecting mechanism 133 is rotated, and the sheet discharge detecting mechanism 133 is in the "sheet presence detection attitude B", so that the remaining sheet detection can be carried out.

In Embodiment 1, in the case when the retraction amount of the belt unit 110 is intended to be increased, there is a need to increase a length of the contact portion 133*a* of the sheet discharge detecting mechanism 133. When the length of the contact portion 133*a* of the sheet discharge detecting mechanism 133 is increased by a predetermined amount or more, the sheet discharge detecting mechanism 133 cannot be returned from the "sheet presence detection attitude B" to the "sheet absence detection attitude A" during a sheet interval between the sheet P and a subsequent sheet P.

Further, the length of the contact portion 133*a* of the sheet discharge detecting mechanism 133 also provides constraints to determination of a minimum arrangement enable distance between the inner sheet discharge roller pair 70 and the nip N. This is because in the case when the inner sheet discharge roller pair 70 is brought near to the fixing nip N and the length of the contact portion 133*a* of the sheet discharge detecting mechanism 133 is increased by the predetermined amount or more, before the contact portion 133*a* of the sheet discharge detecting mechanism 133 is retracted from the feeding path of the sheet P, the contact portion 133*a* contacts the inner sheet discharge roller pair 70 and prevents the feeding of the sheet P.

By carrying out this embodiment, while employing a constitution in which the remaining sheet can be detected with reliability, it is possible to further realize an increase in retraction amount of the belt unit 110 and approach between the inner sheet discharge roller pair 70 and the nip N.

In this embodiment, the opposite guide portions 131*b* of the sheet discharge guide 131 were described as the "guide" portions, but in the feeding process of the sheet P, the opposite guide portions 131*b* may also have a function as a feeding guide by being contacted to the sheet S. Conversely, the portions 131*b* may also be disposed at positions where the portions 131*b* do not contact the sheet P.

Embodiment 3

Embodiment 3 will be described. Also in Embodiment 3, many constitutions are the same as those in Embodiment 1, and therefore, in the following, the constitutions that are different from Embodiment 1 will be principally described. Explanation of the general structure of the printer and a schematic explanation of the fixing device are common to Embodiments 1 and 3, and therefore will be omitted from redundant description.

(Separation Guide)

Only the constitution different from Embodiment 1 will be described using FIG. 12. Parts (a) and (b) of FIG. 12 are schematic views showing a flange member 116A of the belt unit 110 and a separation guide 201 on one end side in this embodiment, in which part (a) of FIG. 12 is a schematic side view of the flange member 116A and the separation guide 201, and part (b) of FIG. 12 is a partially enlarged exploded view of a characteristic portion of the flange member 116A and the separation guide 201. Also, a flange member 116B of the belt unit 110 and a separation guide 201 on the other end side have the same relationship constitution as that on one end side, and therefore, in the following, the flange member 116A and the separation guide 201 on one end side will be described as a representative.

In this embodiment, at an end portion of the separation guide 201 with respect to the longitudinal direction, a portion-to-be-positioned 201*d* is provided. The flange member 116A(B) is provided with an abutment positioning portion 116*e*. The separation guide 201 is urged by a separation guide urging spring 129 so that the portion-to-be-positioned 201*d* of the separation guide 201 abuts against the positioning portion 116*e* of the flange member 116A(B). The separation guide 201 is supported slidably in an urging direction by the spring 129.

On the other end side, the spring 129 is fixed to an immovable component part, such as the device casing 100, together with the belt unit 110 during retraction of the belt unit 110. Both of the flange member 116A(B) and the separation guide 201 are provided with tapered portions 116*f* and 201*e* at surfaces which abut and contact each other when the belt unit 110 moves in a retracting direction.

The device casing 100 is provided with a regulating member 128. The regulating member 128 has a regulating surface 128*a* contacting the separation guide 201 when the portion-to-be-positioned 201*d* of the separation guide 201 moves in the retracting direction. A gap g between the regulating surface 128*a* and the separation guide 201 is set so as to be smaller than a retraction amount (movement amount: 4 mm in this embodiment), and is set at 0.3 mm in this embodiment.

The flange member 116A(B) is provided with a flange regulating portion 116*h* for regulating a position of the separation guide 201 with respect to the feeding direction when the flange member 116A(B) is retracted together with the belt unit 110. Further, a projected portion 116*g* is provided between the tapered portion 116*f* and the regulating portion 116*h* of the flange member 116A(B).

On the other hand, the separation guide 201 is provided with a separation guide regulating portion 201*f* for regulating a feeding direction position thereof during the retraction of the belt unit 110.

Next, operations of respective component parts in the retracting operation of the belt unit 110 with the pressure releasing operation of the pressure releasing mechanisms 126 and 127 will be described using FIG. 13. Part (a) of FIG. 13 shows a pressed state between the belt unit 110 and the pressing roller 120. At this time, the tapered portion 201*e* of the separation guide 201 and the tapered portion 116*f* of the flange member 116A(B) contact each other, so that the portion-to-be-positioned 201*d* of the separation guide 201 and the positioning portion 116*e* of the flange member 116A(B) abut against each other. As a result, the separation guide 201 is in a positioned state to the flange member 116A(B).

From this state, when the retracting operation of the belt unit 110 starts with the pressure releasing operation of the pressure releasing mechanisms 126 and 127, the separation guide 201 starts the retracting operation together with the belt unit 110 and the flange member 116A(B). Then, when the separation guide 201 retracts and moves by 0.3 mm corresponding to the gap g and the portion-to-be-positioned 201*d* contacts the regulating surface 128*a* of the regulating member 128, the separation guide 201 cannot move further in the retracting direction of the belt unit 110.

In that state, the belt unit 110 retracts further. Then, as shown in part (b) of FIG. 13, the separation guide 201 is moved in a direction opposite from the urging direction of the separation guide 201 by the tapered portion 116*f* of the flange member 116 and the tapered portion 201*e* of the separation guide 201. A movement amount at this time is regulated by heights of the separation guide regulating portion 201*f* of the separation guide 201 and the projected portion 116*g* of the flange member 116A(B).

When the retraction of the belt unit 110 is further made, as shown in part (c) of FIG. 13, the separation guide regulating portion 201*f* of the separation guide 201 gets over the projected portion 116*g* of the flange member 116A(B) and contacts the flange regulating portion 116*h* of the flange member 116A(B). In this state, the belt unit 110 has completed the retraction thereof. In this embodiment, the belt unit 110 retracts and moves by 4 mm.

Further, the case when the state of the belt unit 110 is returned to the pressed state again will be described. The regulating member 128 is provided with a regulating surface 128*b* during pressurization provided on a side opposite from the regulating surface 128*a*. The separation guide 201 is provided with a tapered portion 201*g* during pressurization, and the flange member 116A(B) is provided with a tapered portion 116*i* during pressurization.

When a pressing operation of the belt unit 110 toward the pressing roller 120 is started by eliminating the pressure released state of the pressing mechanisms 125A and 125B through a reverse operation of the pressure releasing mechanisms 126 and 127, the separation guide 201 moves together with the belt unit 110 in the pressing direction (advance movement). When the separation guide 201 contacts the regulating surface 128*b* of the regulating member 128, the movement of the pressing direction is provided. Thereafter, the separation guide 201 is moved in a direction opposite from the urging direction of the separation guide 201 by the tapered portions 201*g* and 116*i*, during pressurization, of the separation guide 201 and the flange member 116A(B), respectively.

Thereafter, by an operation reverse to the retracting operation of the belt unit 110, the portion-to-be-positioned 201*d* of the separation guide 201 and the positioning portion 116*e* of the flange member 116A(B) abut against each other again. As a result, the state of the separation guide 201 is returned to the positioned state to the flange member 116A(B).

In this embodiment, the heights of the separation guide regulating portion 201*f* of the separation guide 201 and the flange regulating portion 116*h* of the flange member 116A (B) were set so that as regards the feeding direction of the sheet P, the movement amount of the separation guide 201 was the same as that in the pressed state.

That is, also when the belt unit 110 is retracted, the separation guide 201 is retracted only in the retracting direction of the belt unit 110 by the gap amount between the regulating surface 128*a* and the separation guide 201.

On the side where the separation guide 201 was retracted from the sheet discharge detecting mechanism 133, limitation was provided by forming the regulating surface 128*a*, but on an approaching side, the regulating surface was provided with a latitude to some extent. This is because correspondingly to the approach of the separation guide 201, the overlapping amount of the separation guide 201 with the contact surface 133*a* of the sheet discharge detecting mechanism 133 increases. In this embodiment, the above-described constitution was employed, but for example, the separation guide 201 may also be moved to a position different from that in the pressed state during the completion of the retraction, and regulation may also be made by providing a regulating surface for regulating the separation guide 201 in the approaching direction of the separation guide 201 toward the sheet discharge detecting mechanism 133.

The above-described constitution is summarized as follows. The switching mechanisms 201*e*-201*g* and 116*f*-116*i* for switching the position of the separation guide 201 are provided. When the belt 113 (belt unit 110) is moved by the pressure releasing mechanisms 126 and 127, the separation guide 201 is changed in position relative to the component part 128 other than those on the belt 113 side. The movement amount of the separation guide 201 by this change is smaller than the movement amount of the belt 113 (belt unit 110) by the pressure releasing mechanisms 126 and 127.

(Sheet Discharge Sensor)

A constitution of the sheet discharge sensor is common to Embodiments 1 and 3. In this embodiment, an overlapping amount between the separation guide 201 and the free end of the contact portion 133*a* of the sheet discharge detecting mechanism 133 was 2.0 mm.

(Spacing/Depressurization Constitution During Jam Generation)

This constitution is common to Embodiments 1 and 3. In this embodiment, the retraction amount of the belt unit 110 was 4.0 mm.

(Effect of Execution of this Embodiment)

An effect of execution of this embodiment will be described using FIG. 14. Explanation in the case when this embodiment is not carried out is the same as that in the comparison example (FIG. 9) for Embodiment 1, and therefore will be omitted.

Parts (a) and (b) of FIG. 14 are schematic views showing a state in which the sheet P jammed in the nip N in the case when this embodiment is carried out, i.e., when the overlapping amount R between the separation guide 201 and the free end of the contact portion 133*a* of the sheet discharge detecting mechanism 133 is 4.0 mm, in which part (a) of FIG. 14 shows the pressed state of the belt unit 110 against the pressing roller 120, and part (b) of FIG. 14 shows the state in which the pressure is released and the belt unit 110 and the separation guide 201 are retracted from the pressing roller 120 by 4.0 mm.

In this embodiment, the separation guide 201 retracts and moves together with the belt unit 110, but the retraction amount is limited to 0.3 mm. Accordingly, the separation guide 201 and the contact portion 133*a* of the sheet discharge detecting mechanism 133 maintain the overlapping amount of 1.7 mm even in a state in which the heating device (belt unit) 110 and the separation guide 201 are retracted. That is, (overlapping amount: 2.0 mm)−(movement amount of separation guide 201 during retraction of belt unit 110: 0.3 mm)=(overlapping amount after retraction: 1.7 mm).

Accordingly, until the sheet P is removed, the sheet discharge detecting mechanism 133 is rotated, and the sheet discharge detecting mechanism 133 is in the "sheet presence detection attitude B", so that the remaining sheet detection can be carried out.

Also in Embodiment 3, similarly as in Embodiment 2, even when the retraction amount of the belt unit 110 is set at any value, the contact portion 133*a* of the sheet discharge detecting mechanism 133 and the separation guide 201 continuously overlap with each other, and therefore, remaining sheet detection can be carried out with reliability. Further, it is also possible to achieve the proximity of the inner sheet discharge roller pair 70.

In the above-described Embodiments 1 to 3, in the constitution in which the sheet discharge detecting mechanism 133 is disposed at the portion opposing the separation guide 201 with respect to the sheet flange direction, a desired object is achieved even in the case when the fixing member is spaced or reduced in pressure when the jam occurred. That is, the passing of the sheet P through the sensor can be prevented by employing the constitution in which the contact portion of the sheet discharge detecting mechanism 133 overlaps with the separation guide 201.

Other Embodiments

The fixing device according to the present invention is not limited to the fixing devices described above in Embodiments 1 to 3, but the present invention may also be applicable to a device (apparatus) used for the purpose of modifying glossiness or the like of an image (fixed image or partly fixed image) once or temporarily fixed on the recording material.

The first rotatable member as the rotatable heating member for heating the image carried on the recording material is not limited to the rotatable cylindrical belt member. The first rotatable member may also be a flexible endless belt member which is stretched between a plurality of stretching members and which is rotationally driven or a rotatable belt member having rigidity. Also, the second rotatable member as the rotatable pressing member is not limited to the roller member but can also have a device constitution in which the second rotatable member is formed in an endless belt member.

The heating mechanism for heating the first rotatable member is not limited to the ceramic heater in the above-described embodiments. It is also possible to use other known heating mechanisms of an internal or external heating type, such as a halogen lamp and an infrared lamp. Further, the heating mechanism can also be an exciting coil or a magnetic flux generating means, including the exciting coil and a magnetic core, for heating the first rotatable member through induction heating.

The recording material introduction type of the fixing device can also be a center (line) feeding basis or one-side feeding basis.

The fixing device in the present invention may also be carried out in an image forming apparatus, other than the color electrophotographic printer as in the above-described embodiments, such as a monochromatic copying machine, a facsimile, a monochromatic printer or a multi-function machine of these machines. That is, the fixing device and the color electrophotographic printer in the above-described embodiments are not limited to combinations of the above-described constituent members but may also be realized in other embodiments in which a part or all thereof are replaced with their alternative members.

The image forming type of the image forming portion of the image forming apparatus is not limited to the electrophotographic type but may also be an electrostatic recording type or a magnetic recording type. Further, the image forming type is not limited to the transfer type but may also be a type in which the image is formed on the recording material by a direct type.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A fixing device comprising:

a first rotatable member;

a second rotatable member configured to form a nip with said first rotatable member for fixing a toner image on a recording material;

a moving mechanism configured to move said first rotatable member in a direction away from said second rotatable member;

a flag provided downstream of the nip with respect to a recording material feeding direction, said flag being retractable by contact with the recording material when the recording material passes said flag and being located on one side of the recording material to be fed;

a sensor configured to detect whether or not said flag is retracted by contact with the recording material;

a movable guide configured to guide the recording material on a side downstream of the nip with respect to the recording material feeding direction and located on the other side of the recording material to be fed, and said movable guide being movable, together with said first rotatable member, in the direction away from said second rotatable member and from said flag by said moving mechanism, and being capable of overlapping with said flag as viewed in a rotational axis direction of said second rotatable member in a case in which said first rotatable member and said second rotatable member form the nip; and a stationary member located at a fixed position opposing said flag, irrespective of the position of said movable guide, and located on the other side of the recording material to be fed, wherein, said stationary member is provided at a position farther from a conveying path of the recording material than the movable guide in a case in which said first rotatable member and said second rotatable member form the nip, and said stationary member is provided at a position closer to the conveying path of the recording material than the movable guide and is capable of overlapping with said flag as viewed in a rotational axis direction of said second rotatable member in a case in which said first rotatable member has been moved in the direction away from said second rotatable member by said moving mechanism.

2. The fixing device according to claim 1, wherein said moving mechanism is configured to move said first rotatable member in the direction away from said second rotatable member when a determination that a jam has occurred is made based on an output of said sensor.

3. The fixing device according to claim 1, wherein, when said first rotatable member is in a state in which said first rotatable member has been moved in the direction away from said second rotatable member by said moving mechanism, said first rotatable member contacts said second rotatable member.

4. The fixing device according to claim 1, wherein said flag is swingable to be retracted.

5. The fixing device according to claim 1, wherein said movable guide is configured to separate the recording material from said first rotatable member.

6. A fixing device comprising:

a first rotatable member;

a second rotatable member configured to form a nip with said first rotatable member for fixing a toner image on a recording material;

a moving mechanism configured to move said first rotatable member in a direction away from said second rotatable member;

a flag provided downstream of the nip with respect to a recording material feeding direction, said flag being retractable by contact with the recording material when the recording material passes said flag and being located on one side of the recording material to be fed;

a sensor configured to detect whether or not said flag is retracted by contact with the recording material; and a movable guide configured to guide the recording material on a side downstream of the nip with respect to the recording material feeding direction and located on the other side of the recording material to be fed, and said movable guide being movable, together with said first rotatable member, in the direction away from said second rotatable member and from said flag by said moving mechanism, and being capable of overlapping with said flag as viewed in a rotational axis direction of said second rotatable member in a case in which said first rotatable member and said second rotatable member form the nip, wherein, in a case in which said movable guide has been moved in the direction away from said second rotatable member and from said flag by said moving mechanism and said flag is not in contact with the recording material, a part of said flag and said movable guide are in an overlapping positional relationship with each other when viewed in a rotational axis direction of the second rotatable member.

7. The fixing device according to claim 6, wherein, when said first rotatable member forms the nip in cooperation with said second rotatable member, said flag and said movable guide are in an overlapping positional relationship with each other as viewed in the rotational axis direction of said second rotatable member.

8. The fixing device according to claim 6, wherein said moving mechanism is configured to move said first rotatable member in the direction away from said second rotatable member when a determination that a jam has occurred is made based on an output of said sensor.

9. The fixing device according to claim 6, wherein, when said first rotatable member is in a state in which said first rotatable member has been moved in the direction away from said second rotatable member by said moving mechanism, said first rotatable member contacts said second rotatable member.

10. The fixing device according to claim 6, wherein said flag is swingable to be retracted.

11. The fixing device according to claim 6, wherein said movable guide is configured to separate the recording material from said first rotatable member.

* * * * *